US009010059B2

(12) United States Patent
Lin

(10) Patent No.: US 9,010,059 B2
(45) Date of Patent: Apr. 21, 2015

(54) BUILDING BLOCKS AND BUILDING BLOCK FASTENERS

(75) Inventor: Chi Kin Lin, Hong Kong (CN)

(73) Assignee: Value Chain Network (Hong Kong) Limited, Kawai Chung, New Territories (HK)

( * ) Notice: Subject to any disclaimer, the term of this patent is extended or adjusted under 35 U.S.C. 154(b) by 0 days.

(21) Appl. No.: 13/700,901

(22) PCT Filed: Dec. 8, 2011

(86) PCT No.: PCT/IB2011/055542
§ 371 (c)(1),
(2), (4) Date: Mar. 7, 2013

(87) PCT Pub. No.: WO2012/104685

PCT Pub. Date: Aug. 9, 2012

(65) Prior Publication Data

US 2013/0312357 A1 Nov. 28, 2013

(30) Foreign Application Priority Data

Jan. 31, 2011 (HK) ..... 11101021.8
Jun. 10, 2011 (HK) ..... 11105899.8
Nov. 24, 2011 (HK) ..... 11112781.5

(51) Int. Cl.
*E04C 1/00* (2006.01)
*A63H 33/10* (2006.01)

(52) U.S. Cl.
CPC ..... *E04C 1/00* (2013.01); *A63H 33/106* (2013.01); *A63H 33/107* (2013.01)

(58) Field of Classification Search
CPC ..... A63H 3/04; A63H 3/08; A63H 3/12; A63H 3/44; A63H 3/086; A63H 3/107; A63H 3/108; E04F 13/0889; E04F 13/0802; E04F 15/021; E04B 1/61; E04B 1/046; E04B 2/06; E04B 2/7425; E04B 2/7448; E04C 1/00
USPC ..... 52/296, 585.1, 589.1, 592.6, 568–572, 52/596, 600, 603, 604, 606–608, 605, 52/561–563, 582.1, 582.2; 446/118, 446/123–128, 117 X, 122 X; 273/153 R, 273/157 R, 153 S, 159, 156; 411/45–48, 411/349, 509, 411, 338, 549, 553; 403/408.1
See application file for complete search history.

(56) References Cited

U.S. PATENT DOCUMENTS 3,005,282 A 10/1961 Christiansen
3,034,254 A 5/1962 Christiansen
(Continued)

FOREIGN PATENT DOCUMENTS

CN 2817942 9/2006
CN 101791481 8/2010
(Continued)

OTHER PUBLICATIONS

International Search Report for PCT/IB2011/055542 dated May 3, 2012.

*Primary Examiner* — Beth Stephan
(74) *Attorney, Agent, or Firm* — Nixon Peabody LLP; Jeffrey L. Costellia

(57) ABSTRACT

A building block (100) comprises a first mating portion and a second mating portion which are complementary. The first mating portion comprises a mating protrusion (140) which defines an axially extending through bore (144) and the second mating portion comprises an axially extending mating receptacle (180) which is complementary to the mating protrusion (140). The mating protrusion (140) and the mating receptacle (180) are in communication via the through bore (144), and a fastener anchoring device (146) adapted for engaging with an engagement means (920) of a fastener (900) is formed inside the through bore (144). The through bore (144) is adapted to permit axial insertion of the engagement means (920) of the fastener (900) into the mating protrusion (140). The fastener anchoring device (146) is adapted to obstruct axial passage of the engagement means (920) until the engagement means (920) overcomes the obstruction by negotiating rotationally with the fastener anchoring device (146) to thereby gain axial advancement and enter into engagement with the fastener anchoring device (146).

18 Claims, 33 Drawing Sheets

(56) References Cited

U.S. PATENT DOCUMENTS

| | | | | |
|---|---|---|---|---|
| 3,597,875 | A | 8/1971 | Christiansen | |
| 5,078,354 | A * | 1/1992 | Kim | 52/562 |
| 5,413,441 | A * | 5/1995 | Heminger et al. | 411/55 |
| 5,718,549 | A * | 2/1998 | Noda et al. | 411/553 |
| 5,771,650 | A * | 6/1998 | Williams et al. | 52/568 |
| 5,987,840 | A * | 11/1999 | Leppert | 52/592.6 |
| 6,088,987 | A * | 7/2000 | Simmons et al. | 52/592.6 |
| 6,676,177 | B2 * | 1/2004 | Daoud et al. | 292/202 |
| 6,736,691 | B1 * | 5/2004 | Bach | 446/128 |
| 6,996,945 | B2 * | 2/2006 | Doty | 52/585.1 |
| 7,267,598 | B2 * | 9/2007 | Glickman | 446/124 |
| 7,547,020 | B1 | 6/2009 | Kohavi | |
| 7,736,211 | B2 * | 6/2010 | Marzetta | 446/122 |
| 8,430,615 | B2 * | 4/2013 | Chen et al. | 411/107 |
| 8,464,482 | B2 * | 6/2013 | Raynor | 52/296 |
| 2006/0194505 | A1 * | 8/2006 | Rolf | 446/118 |
| 2007/0271868 | A1 * | 11/2007 | Abella | 52/600 |
| 2008/0160875 | A1 * | 7/2008 | Leicht | 446/124 |
| 2009/0215357 | A1 | 8/2009 | Seligman | |

FOREIGN PATENT DOCUMENTS

| | | | | |
|---|---|---|---|---|
| EP | 1464369 | A1 * | 10/2004 | A63H 33/10 |
| WO | WO 00/41792 | A1 | 7/2000 | |

* cited by examiner

Figure 1C
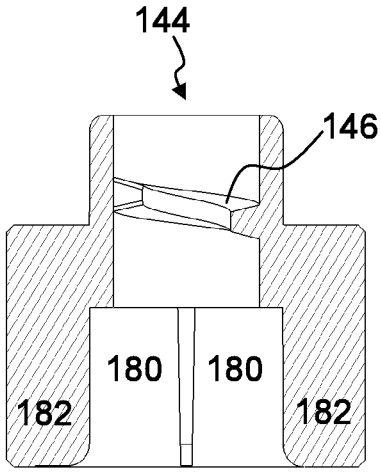
Figure 1D
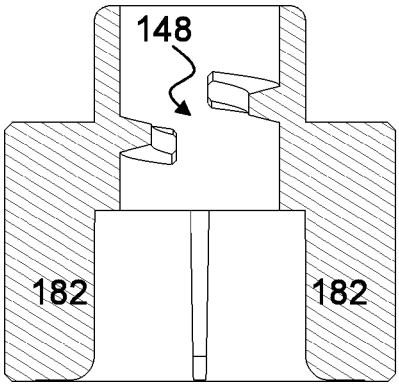
Figure 1E

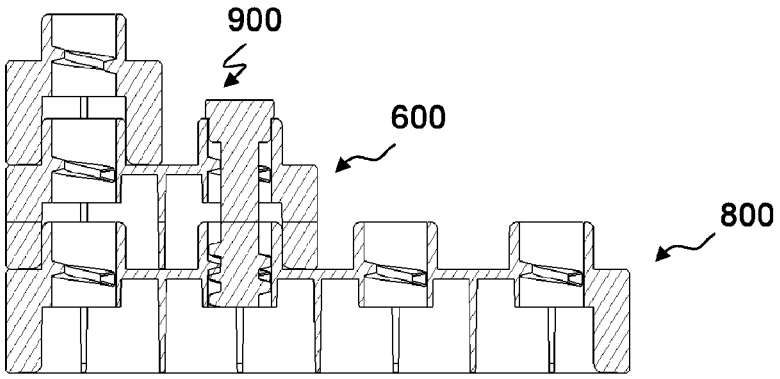
Figure 12D
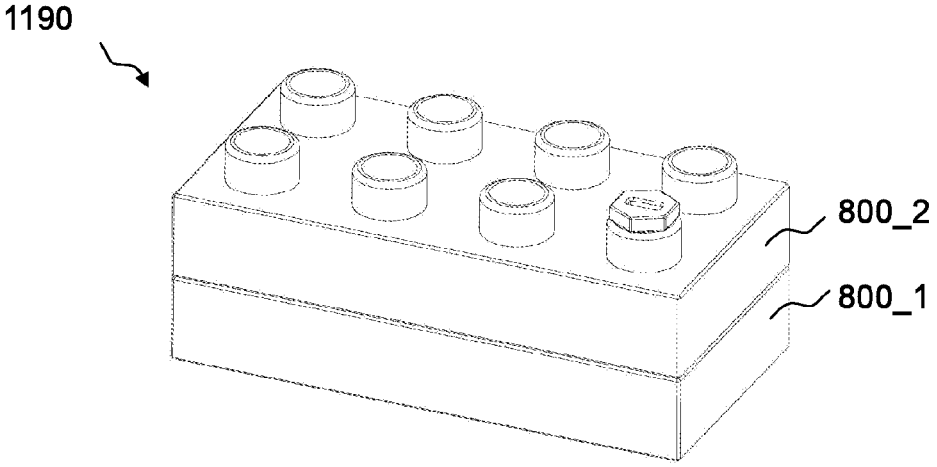
Figure 13
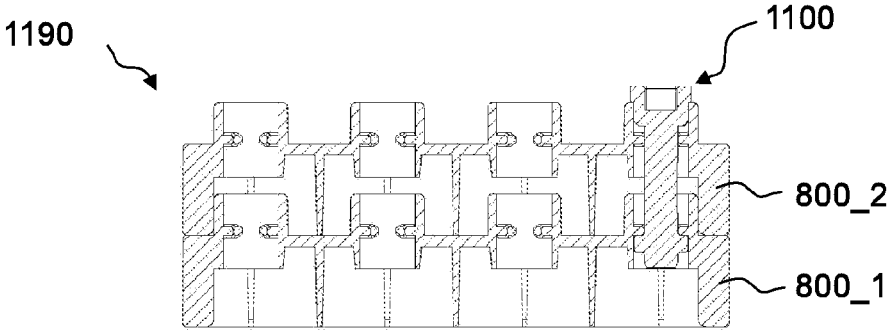
Figure 13A
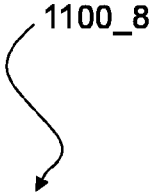

Layer 5

Layer 6

Layer 7

Layer 8

Layer 9

BUILDING BLOCKS AND BUILDING BLOCK FASTENERS

CROSS-REFERENCE TO TRELATED APPLICATIONS

This application claims the benefit of PCT Application No. PCT/IB2011/055542, filed Dec. 8, 2011.

FIELD OF THE INVENTION

The present invention relates to building blocks, and more particularly, to building blocks having complementary mating portions on opposite sides for stackable assembly of structures. This invention also relates to toys, furniture and building structures assembled from interlocked building blocks.

BACKGROUND OF THE INVENTION

Many structures, such as toys, buildings, and furniture, are assembled from modular components which are generally referred to as building blocks.

U.S. Pat. Nos. 3,005,282, 3,034,254, and 3,597,875 disclose stackable toy building bricks which are adapted for forming multi-layered or high-rises toy structures by interlocking of stacked building bricks. Such building bricks typically comprise a molded main body of hard plastics having an upper mating surface, a lower mating surface and side surfaces defines by a periphery. The upper mating surface comprises a plurality of cylindrical mating protrusions and the lower mating surface comprises a corresponding plurality of hollow cylindrical protrusions which cooperate with the side surfaces of the peripheral to collectively define mating receptacles for receiving the mating protrusions on the upper mating surface of a building brick immediately below in a press fitted manner to provide friction interlocking. While the mating protrusions are typically of a generally cylindrical shape, building blocks having prismatic but non-cylindrical upper mating protrusions are also known, for example in EP 1,464,369.

Modular building bricks are advantageous and have been widely used because they provide a high degree of freedom and flexibility to permit creation and construction of useful and aesthetic structures. However, it is noted that interlocking of building blocks to form a secured structure could be difficult.

In this specification, 'building block' includes toy building blocks such as those commonly referred to as 'building bricks', and non-toy building blocks such as modular components used for building, furniture, equipment or vehicle construction.

SUMMARY OF THE INVENTION

Accordingly, there is provided a building block comprising a first mating portion and a second mating portion which are on opposite sides and are complementary, wherein the first mating portion comprises a mating protrusion which defines an axially extending through bore and the second mating portion comprises an axially extending mating receptacle which is complementary to the mating protrusion, the mating protrusion and the mating receptacle being axially aligned and extending in opposite directions; wherein the mating protrusion and the mating receptacle are in communication via the through bore, and a fastener anchoring device adapted for engaging with an engagement means of a fastener is formed on an inside portion of the protrusion means defining the through bore.

In one aspect, the through bore is adapted to permit axial insertion of the engagement means of the fastener into the mating protrusion, and the fastener anchoring device is adapted to obstruct axial passage of the engagement means until the engagement means overcomes the obstruction by negotiating rotationally with the fastener anchoring device to thereby gain axial advancement and enter into engagement with the fastener anchoring device.

In an example, the fastener anchoring device comprises an engagement portion protruding radial inward from the inside portion of the protrusion means defining the through bore.

The fastener anchoring device permits releasable interlocking of a plurality of building blocks to facilitate fixation of a structure constructed from the building blocks.

For example, the fastener anchoring device may comprise an overhanging portion projecting radial inwardly from the portion of the mating protrusion defining the through bore. The projecting overhanging portion defines a secondary aperture inside the through bore. The secondary aperture is large enough to permit sliding through passage of the shaft portion of the fastener but not large enough to permit slide through passage of the engagement means of the fastener.

The overhanging portion may be formed into a helical threaded portion or into the shape of a split washer. This facilitates threaded locking with a fastener having a threaded or un-threaded engagement means. An example of an unthreaded engagement means include radial projecting studs or bosses distributed on the periphery on an end portion of a fastener having a shaft portion of a reduced dimension compared to the projection of the protruding studs.

In an example, the building block is adapted to be interlocked with another building block using a fastener which comprises a head portion, an end portion and a shaft portion intermediate the head portion and the engagement means; and the through bore and the fastener anchoring device are adapted to permit free slide-through passage of the shaft portion of the fastener. Where the through bore is adapted to permit slide-through passage of the shaft portion of the fastener, the shaft portion of the fastener will not be engaged or restrained by the building block or building blocks containing it, thereby permitting the building blocks to be aligned and aligned in different orientations relative to each other or to change relative orientations when desirable or necessary.

In an example building block, the tubular portion is adapted to block entry of the head portion of the fastener into the through bore. To cooperate with this building block, the mating receptacle is complementary to an assembly comprising the mating protrusion and the head portion of the fastener protruding above the mating protrusion which is blocked by the mating protrusion during use.

In addition, there is also provided a building block fastener adapted for interlocking a plurality of building blocks of the type disclosed herein, the fastener comprising a head portion, an end portion comprising an engagement means, and a shaft interconnection the head and end portion; wherein the engagement means on the end portion is adapted to be obstructed by the fastener anchoring device but is adapted to gain axial advancement and entry into engagement with the fastener anchoring device upon overcoming the obstruction by rotating into the fastener anchoring device, the shaft portion is adapted to pass through the building blocks unrestrained from axial movement or unengaged; and the head portion is adapted to be blocked by the first building block.

The fastener may be integrally moulded of hard plastics or integrally formed of metal such as stainless steel.

The fastener is advantageous because it permits interlocking of building blocks regardless of the relative orientation of the building blocks when the building blocks are in mated coupling. For example, the fastener permits inter-building block fastening of building blocks for a series of building blocks in mated coupling, regardless whether the building blocks are parallel or orthogonally aligned, because the fastener is capable of interlocking the building blocks whether the building blocks are parallel aligned, orthogonally aligned, or aligned at an angle between parallel and perpendicular alignment. The flexible building block interlocking is made possible because the shaft portion of the fasteners is unrestrained from axial movement by or unengaged with a building block. At the same time, interlocking of a series of building block is made possible by such a fastener when two ends of the fastener are anchored on the ends of a series of building blocks in mated coupling, with the fastener entering into threaded engagement only with a destination building block only.

In another aspect, there is provided a structure comprising a plurality of building blocks according to the present disclosure interlocked by a plurality of fasteners according to the present disclosure.

The first mating portion of each building block may comprise a plurality of mating protrusions distributed in a regular rectangular array or a regular rectangular matrix, and the second mating portion of each building block comprises a corresponding plurality of mating indentations also distributed in the regular rectangular array or the regular rectangular matrix such that a mating protrusion on the first mating portion is aligned with a corresponding complementary mating indentation on the second mating portion; wherein each said mating protrusion is in communication with a corresponding aligned mating indentation via a through bore.

The expression unrestrained herein means unhindered, unfettered, unobstructed or unengaged with, and the shaft portion of the fastener is freely rotatable or slidable with respect to the through bore when unrestrained.

BRIEF DESCRIPTION OF DRAWINGS

Exemplary building blocks illustrating the above features will be explained below by way of example and with reference to the accompanying figures, in which:—

FIGS. 1A, 1B and 1C are respectively a side view, the top plan view, and the bottom plan view of the building block of FIG. 1, FIGS. 1D and 1E are respectively cross-sectional views taken along lines A-A and B-B of FIG. 1B, FIGS. 12, 12A to 12D are respectively perspective, side, front, and cross-sectional views along lines DD and EE of an example structure of building blocks.

DESCRIPTION OF EXEMPLARY EMBODIMENTS

Figure 1:
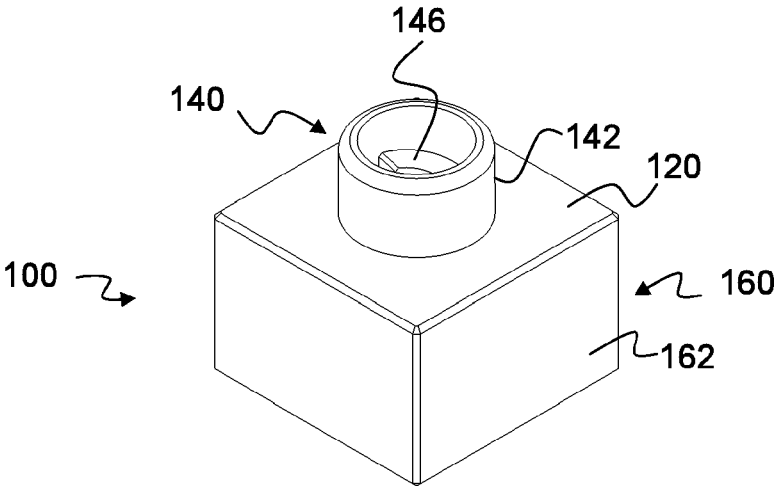
FIG. 1 is a top perspective view showing a first example building block.
Figure 1A:
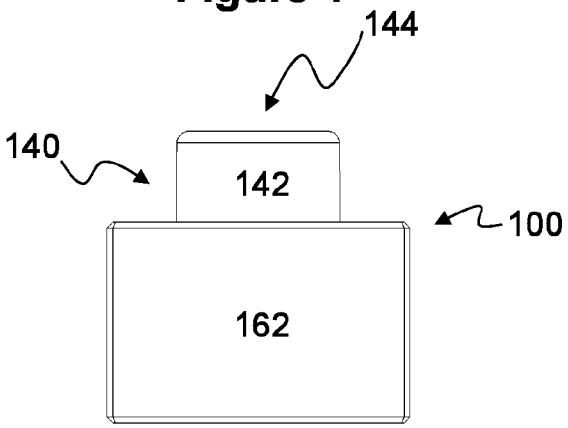

A first example building block 100 shown in FIGS. 1 to 1E comprises a plastic moulded main body. The main body comprises a base panel 120, an upper mating portion comprising a tubular portion 140 protruding upwardly from the base panel 120, a peripheral skirt 160 which projects downwardly from and surrounding the base panel 120, and a lower mating portion comprising a receptacle 180 defined by a partitioning structure inside peripheral skirt 160. The base panel 120 is square or substantially square, and the tubular portion is centrally or substantially located on the base panel.

The tubular portion 140, as an example of an upper mating protrusion of a building block, comprises a cylindrical wall 142 which projects vertically upwards and away from the base panel 120. The tubular portion defines an internal bore 144 which extends through the panel member 120, thereby facilitating communication between the upper mating portion and the lower mating portion of the building block 100. The bore axis of the internal bore 144 is parallel to the axis of the cylindrical wall 142 which defines the tubular portion 140, and is orthogonal to the surface of the base panel 120.

The peripheral skirt 160 projects vertically downwards from the base panel 120 and comprises four side panels 162, each extending vertically downwardly from an edge of the square base panel 120. Each of the side panels 162 has a uniform depth so that when the building block 100 lies on a flat or leveled surface, the upper surface of the base panel 120 will be parallel to the flat or leveled surface.

The peripheral skirt 160 also defines a receptacle 180 by a partitioning structure. The receptacle 180, as an example of a part of a lower mating portion of the building block, is adapted to receive an upper mating protrusion of a compatible building block in a closely fitted manner so that the building block will be mechanically coupled or engaged with the building block below when the upper mating portion of the building block below is fully inserted into the receptacle 180. The partitioning structure is formed of a plurality of partitioning panels 182. Each partitioning panel 182 is parallel to the bore axis of the bore 144 and projects orthogonally towards the interior centre of the peripheral skirt 160 from a central location on a side panel 162. In other words, each of the partitioning panels 182 extends towards the center axis of the receptacle 180, but stops before reaching the center axis of the receptacle 180, which is also the interior center of the peripheral skirt 160 to define the outer boundary of the receptacle 180. As the receptacle 180 is adapted to facilitate friction-fit engagement with an upper mating protrusion of another building block, it is complementary to the tubular portion and has a cylindrical outer boundary. As the tubular portion 140 and the receptacle 180 are axially aligned and share a common axis, the receptacle 180 is immediately below the tubular portion 140.

Figure 1B:
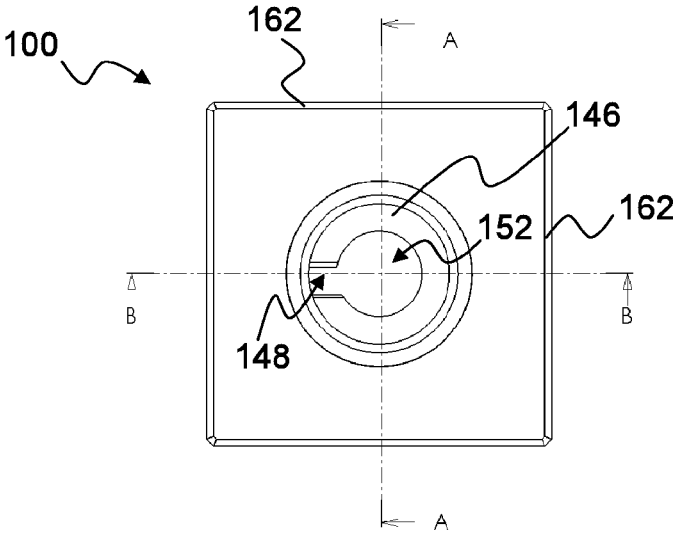

A threaded portion comprising a single helical thread 146 as an example of a fastener anchoring device is disposed inside the cylindrical wall 142. The helical thread is integrally moulded on the interior of the cylindrical wall 142 and projects radial inwards towards the centre axis of the cylindrical wall which defines the tubular portion 140. The single helical thread 146 has less than one complete turn, and a gap 148 is left between the ends of the helical thread, as shown in FIGS. 1B, 1C and 1E. The innermost edge of the helical thread defines a through aperture 152 which in turn defines the maximum transversal internal clearance of the tubular portion 140. The through aperture 152, as an example of a through bore to permit unrestrained or unengaged passage of the shaft portion of an inter-block fastener, is defined by the diametrically opposing thread edge portions to permit unobstructed through passage of a shaft portion of a fastener to be explained below. The helical thread 146 may also taper towards the central bore axis where tapered thread edges are used.

Figure 2:
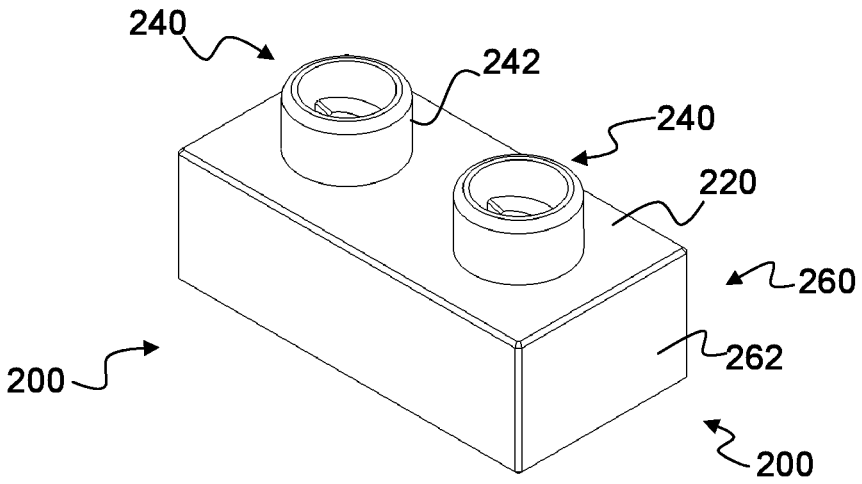
FIG. 2 is a top perspective view showing a second example building block.
Figure 2A:
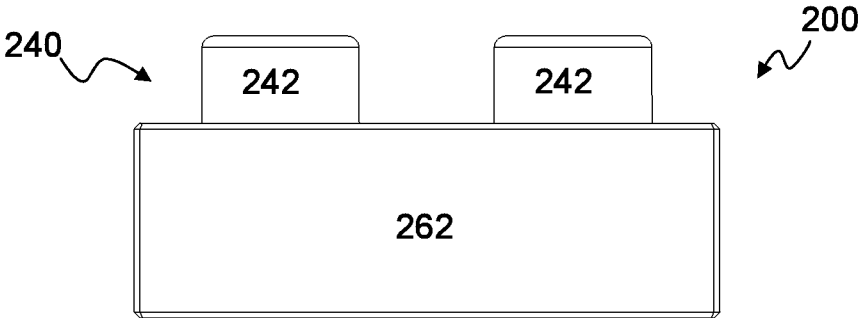
FIGS. 2A, 2B and 2C are respectively a side view, the top plan view, and the bottom plan view of the building block of FIG. 2, FIGS. 2D and 2E are respectively cross-sectional views taken along lines A-A and B-B of FIG. 2B, FIGS. 3, 4 and 5 are top perspective views respectively of a third, a fourth and a fifth example building block.
Figure 2B:
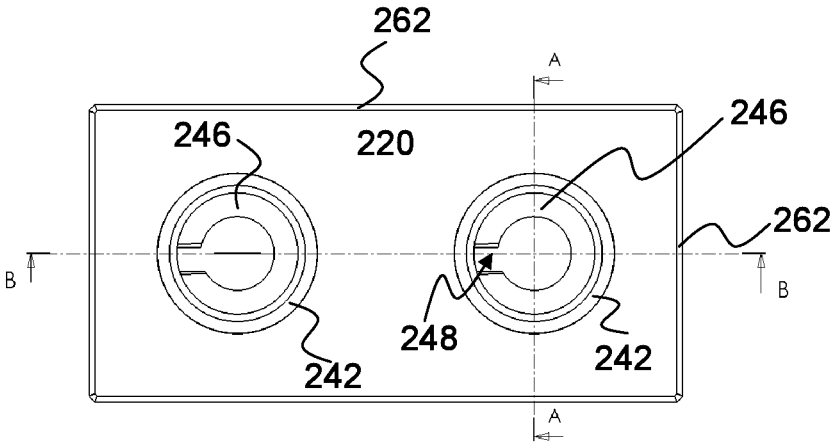
Figure 2C:
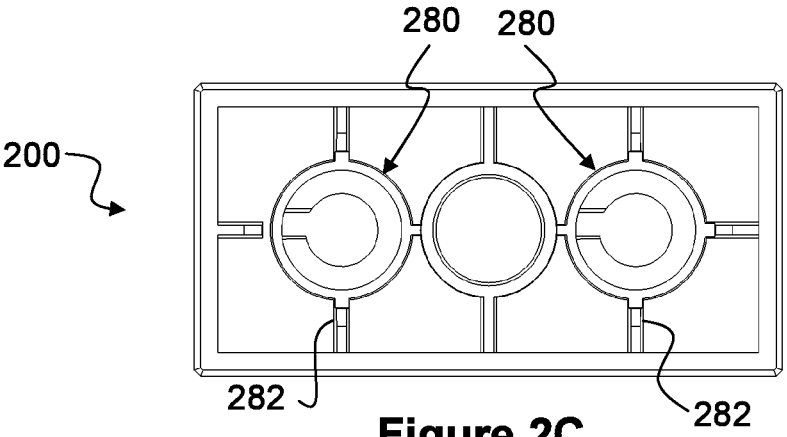
Figure 2D:
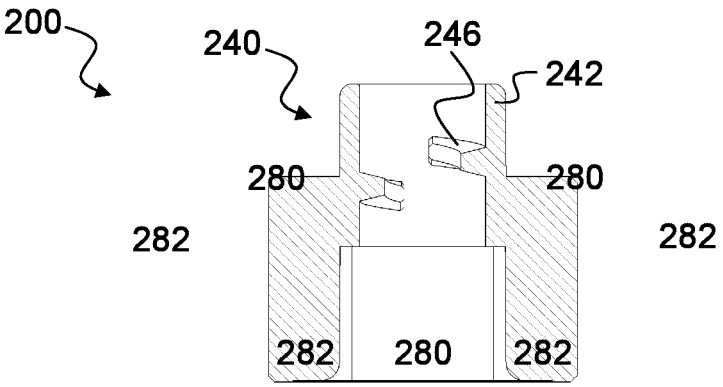
Figure 2E:
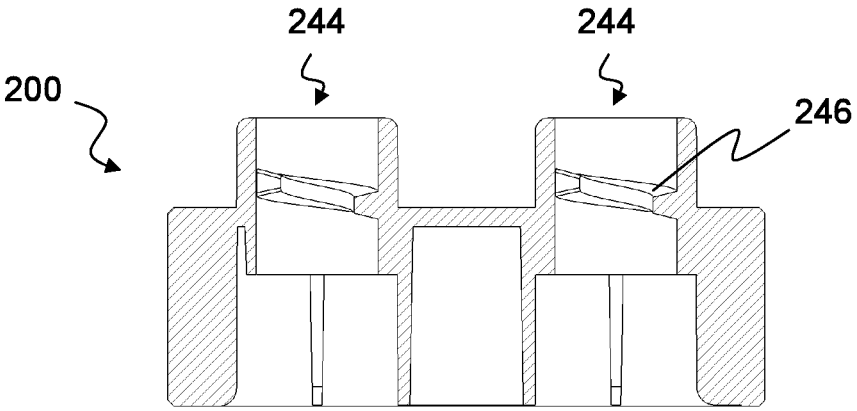

A building block 200 as shown in FIGS. 2 to 2E is substantially identical to that of the building block 100, except that the upper mating portion of the building block 200 comprises two upper mating protrusions in the form also of tubular portions 240 disposed on a rectangular base panel 220 while the building block 100 comprises only one upper mating protrusion disposed on a square base panel 120. Similar to the building block 100, each of the tubular portion 240 is defined by a cylindrical wall 242. A cylindrical receptacle 280 coaxial with the tubular portion 240 and defined by a partitioning structure comprising partitioning panels 282 is disposed immediately underneath the tubular portion 240. Each partitioning panel extends orthogonally from the side panels 262 of the peripheral skirt 260 towards the interior centre axis of the receptacle The base panel 220 is rectangular and has a length-to-width aspect ratio of 2:1 such that the length is two times the width, and the width is the same as the width of the building block 100 for convenient stackability. As such, the base panel 220 can be considered to be formed by joining two square base panels 120 of the building block 220 along a longitudinal centerline (B-B) which extends along the longitudinal axis of the base panel 220 and divides the rectangular surface of the base panel 220 into two equal elongate parts as depicted in FIG. 2B. The two tubular portions 240 are disposed such that each tubular portion 240 is concentric with the center of the square base panel portion containing the tubular portion 240, and the separation distance between the two tubular portions 240 is equal to the width of the square panel portion. As each receptacle 280 is axially aligned with a corresponding tubular portion, the receptacles 280 are also disposed such that each receptacle is concentric with the center of the square base panel portion containing the receptacle 280. Similar to the building block 100, a helical threaded 246 of same characteristics is formed on the interior surface of the cylindrical wall 242 which defines the tubular portion 240. Other features of the building block 200 are identical to that of the building block 100. Accordingly, the description above in relation to the building block 100 is incorporated herein by reference with numerals on the same or equivalent features added by 100 for succinctness and applied mutatis mutandis to the building block 200 where appropriate.

Figure 3:
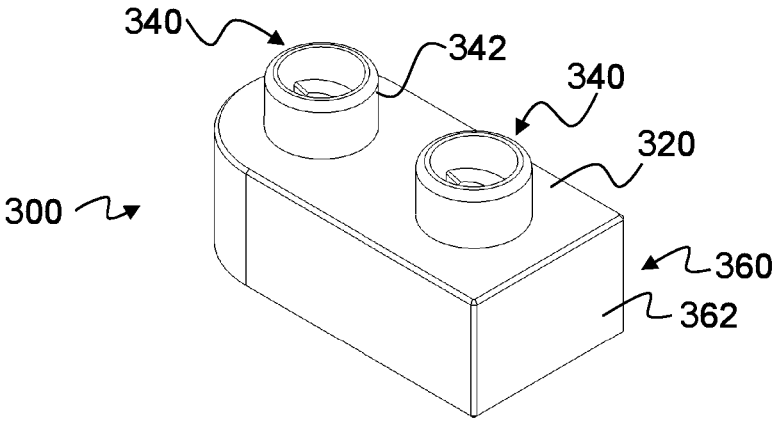

A building block 300 shown in FIG. 3 is substantially identical to that of the building block 200, except that building block 300 comprises a rounded end portion. The rounded end portion is a rounding truncation of an elongate end of the building block 200 and the side panel at the rounded end portion is concentric with the tubular portion 340 or the cylindrical wall 342 defining the tubular portion. The rounded end portion of the building block may be used to form part of a hinge of a structure to be explained below. Other features of the building block 300 are otherwise identical to that of the building block 200, and the description above in relation to the building block 200 is incorporated herein by reference with numerals on the same or equivalent features on the building block 200 added by 100 for the sake of succinctness, and applied mutatis mutandis where appropriate.

Figure 4:
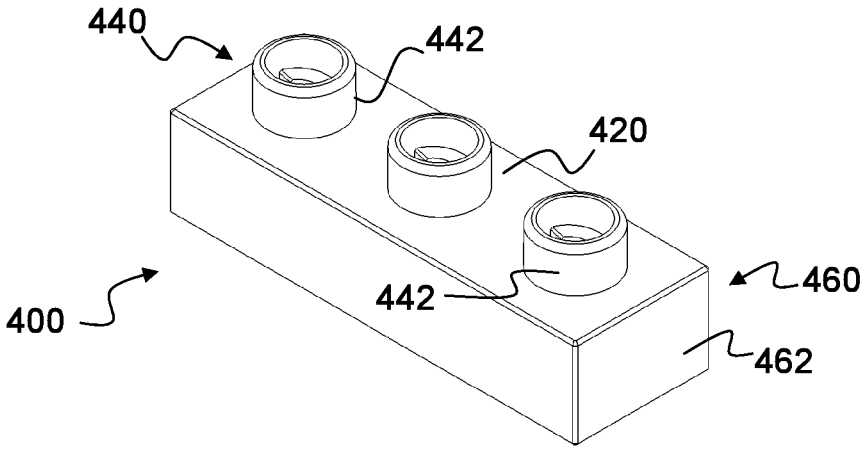

A building block 400 depicted in FIG. 4 is identical to that of the building block 200, except that the rectangular base panel 420 has a length-to-width aspect ratio of 3:1 and the width is the same as that of the building block 100, 200 and 300. In addition, 3 tubular portions 440 are disposed at regular intervals along the centerline of the rectangular base panel 420 such that the separation distances between adjacent tubular portions 440 are the same and equal to the width of the base panel 100 of the building block 100. Likewise, the rectangular panel 420 can be regarded as being a collocation of 3 square base panel portions joined along the longitudinal centerline, and each one of the tubular portions 440 is disposed at the center of the square base panel portion containing that tubular portion 440. The features of the building block 400 are otherwise identical to that of the building block 200. Accordingly, the description above in relation to the building block 200 is incorporated herein by reference with numerals on the same or equivalent features added by 200 for succinctness and applied mutatis mutandis where appropriate.

Figure 5:
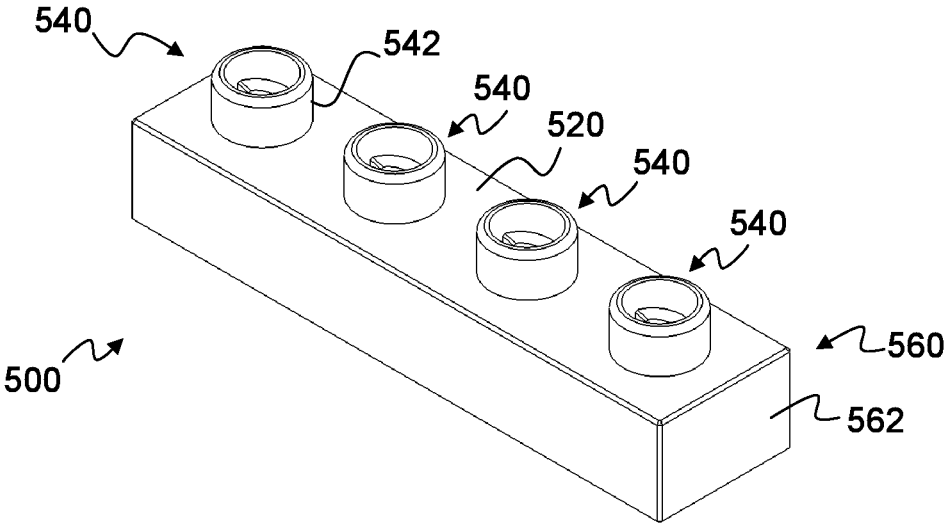
Figure 6:
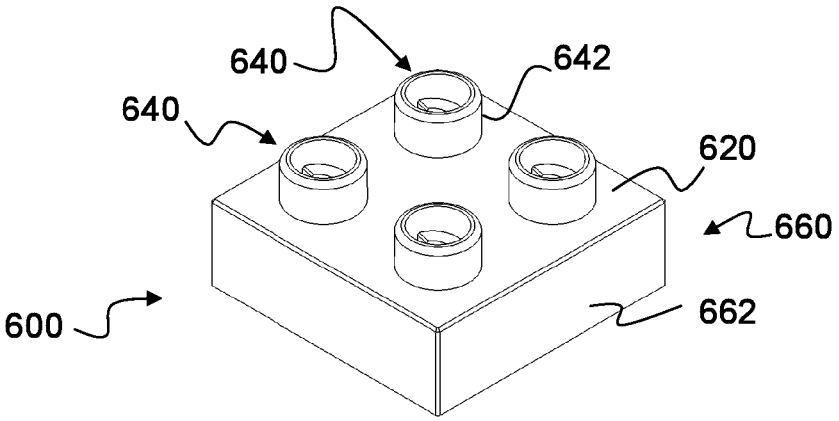
FIGS. 6, and 6A to 6D are respectively the top plan view, the bottom plan view, and cross-sectional views along lines AA and BB of FIG. 6A of a sixth example building block.
Figure 6A:
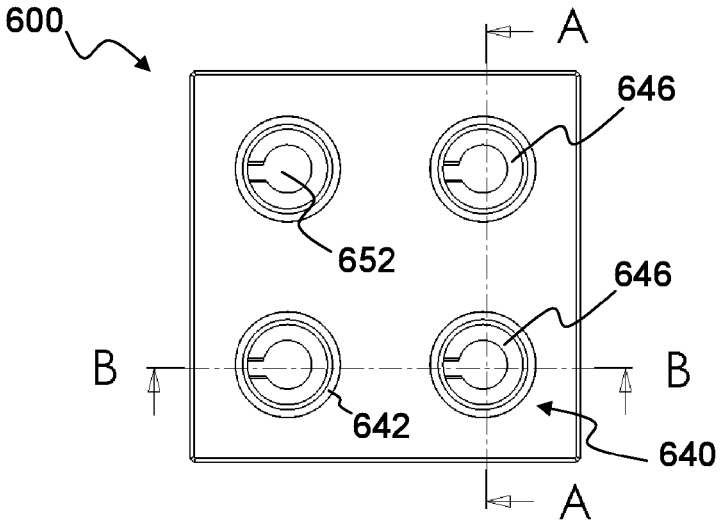
Figure 6B:
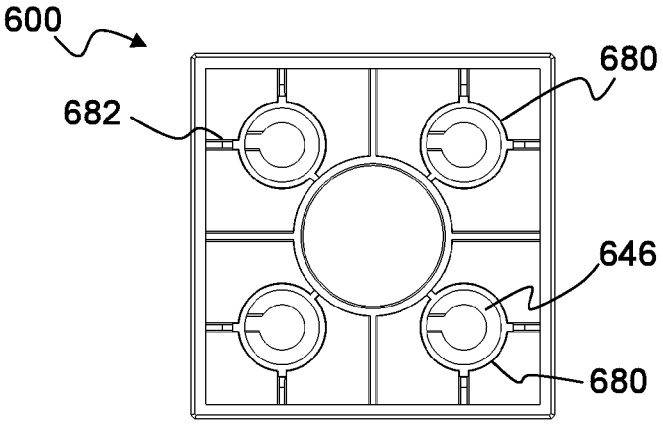
Figure 6C:
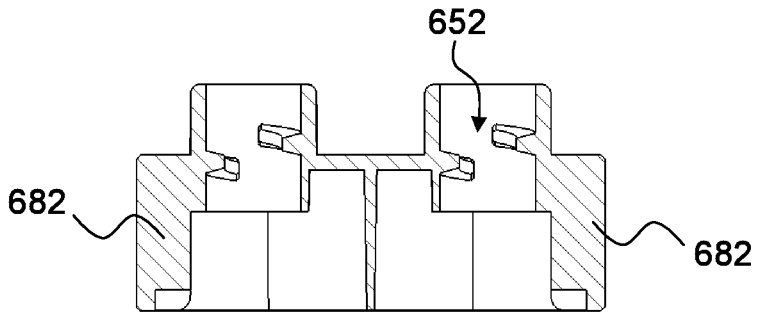
Figure 6D:
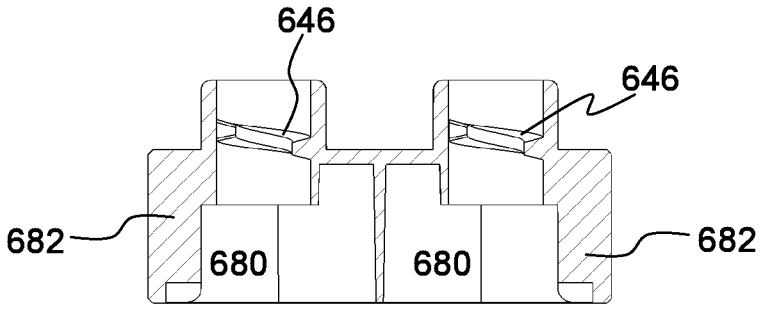

A building block 500 depicted in FIG. 5 is identical to that of the building block 400, except that the rectangular base panel 520 has a length-to-width aspect ratio of 4:1 compared to the aspect ration of 3:1 of the building block 400. In addition, a total of 4 tubular portions 540 are disposed at regular intervals along the centerline of the rectangular base panel 520 such that the separation distances between adjacent tubular portions are the same. As the features of the building block 500 are otherwise identical to that of the building block 400, the description above in relation to the building block 400 is incorporated herein by reference with numerals on the same or equivalent features added by 100 and applied mutatis mutandis.

It will be noted that from the above that the tubular portions of the building blocks 200, 300, 400 and 500 are all distributed on a regular linear array of 1×n along a longitudinal axis at a constant separation distance, where n is an integer. While n can be any integer, it will be appreciated that n is usually equal to or less than 10 for most practical applications.

A building block 600 depicted in FIGS. 6, 6A to 6D comprises a plastic moulded main body defining a base panel 620; four tubular portions 640, each protruding upwardly from the base panel 620 and comprising a threaded portion moulded inside the tubular portion; a peripheral skirt 660 which projects downwardly from and surrounding the base panel 620; and four receptacles 680 each defined by a partitioning structure comprising a plurality of orthogonally extending partitioning panels 682 inside the peripheral skirt 660. Each of the tubular portions 640 and each of the receptacles 680 are identical to those described herein in relation to the building block 100 and building block 200, and the descriptions on common features are incorporated herein by reference. The base panel 620 is square and has a length-to-width aspect ratio of 2:2, and the width of the base panel 620 is two times that of the base panel 120. With an aspect ratio of 2:2, the base panel 620 can be considered as a collocation of 4 square base panels 120 of the building block 100, and each one of the four tubular portions 640 is concentric with the center of the square panel portion containing it. Similarly, each one of the four receptacles 680 is concentric with the center of the square panel portion containing it. Each receptacle 680 is axially aligned with a corresponding tubular portion 640 contained in the same square panel portion, albeit on opposite sides of the base panel 620. The tubular portions 640 and the receptacle 680 are distributed on a regular 2×2 matrix of equal separation distance. Other features of the building block 600 are otherwise identical to that of the building block 200, and the description above in relation to features in common is incorporated herein by reference with numerals on the same or equivalent features on the building block 200 added by 400 for succinctness and applied mutatis mutandis where appropriate. In one perspective, the building block 600 can be considered as being formed by two pieces of building block 200 by merging the long sides together with longitudinal ends aligned.

Figure 7:
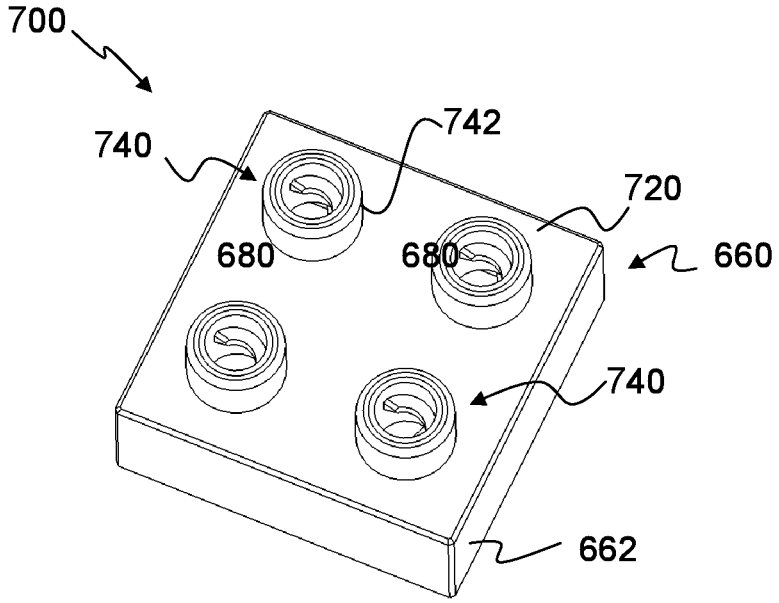
FIGS. 7, 7A and 7B are respectively a top perspective view, an exploded view and a cross-sectional view of the exploded view of a seventh example building block.
Figure 7A:
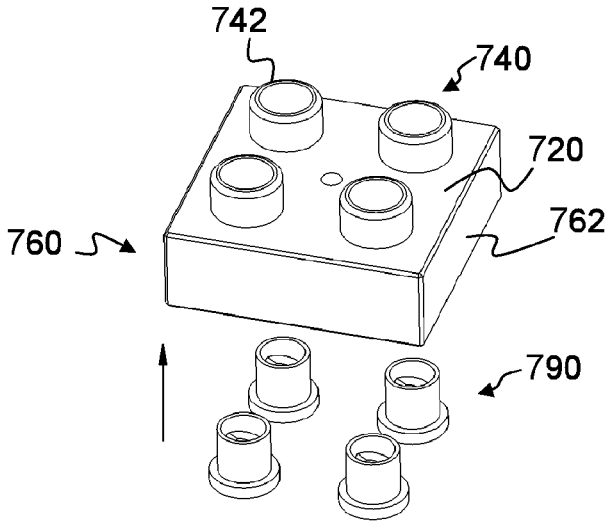
Figure 7B:
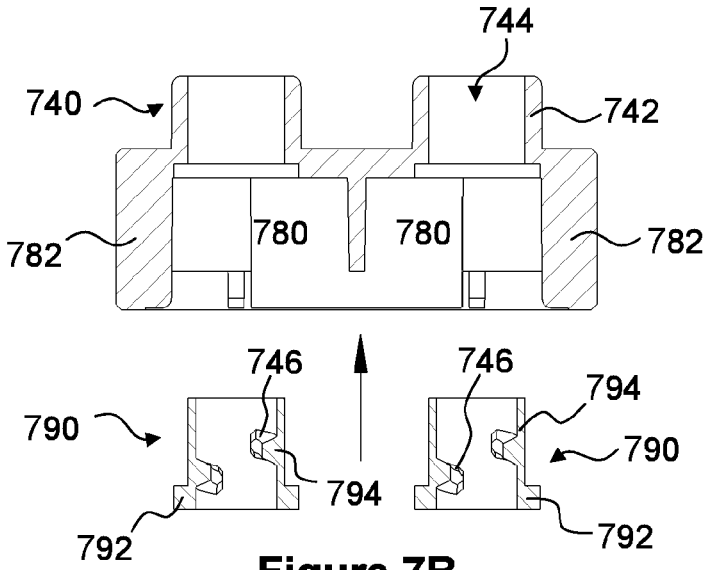

A building block 700 depicted in FIGS. 7, 7A and 7B is identical to that building block 600, except that the threaded portion is not integrally moulded on the cylindrical wall of the tubular portion, but is formed on an insert 790 for retrofitting onto the tubular portion 740. The insert 790 comprises a plastic moulded main body which resembles a hollow plug having a boss 792 with an enlarged base area and a tubular portion 794 projecting upwardly or orthogonally from the boss. A helical thread 746 is integrally moulded on the interior of a cylindrical wall 742 which defines the tubular portion 740 and the helical thread 746 is similar to that described above in relation to other building blocks. The insert 790 is mounted onto the base panel 720 by welding, bonding, fusion, gluing or other attachment methods. Similar to the other examples, the threaded portion has less than one complete turn to facilitate simple moulding. The boss portion is adapted such that its transverse dimension exceeds the clearance on the bottom entry side of the tubular portion 740 of the building block 700, such that the boss 792 will be retained underneath the base panel 720 when the tubular port 794 of the insert 790 is fitted into the tubular portion 740.

To assemble the building block 700, the plug-shaped insert member is inserted from the underside of the building block, with the tubular portion entering the bore of the tubular portion 740 moulded on the building block 700, and the boss portion underneath the tubular portion 740. After the tubular portion has been fully inserted into the through bore, the boss portion will be stopped from moving further into the tubular portion of the building block and the insert is secured onto the underside of the base panel to complete assembly. Apart from having a retrofitted insert member, the building block 700 is identical to that of the building block 600. Accordingly, the descriptions above in relation to the building block 600 are incorporated herein by reference with numerals on the same or equivalent features added by 100 for the sake of succinctness.

A building block 800 depicted in FIGS. 8, and 8A to 8D is identical in all aspects to the building block 500 or the building block 600, except that the base panel 820 has a width which is two times that of the width of the base panel 120 of building block 100 and has a length-to-width aspect ratio of 4:2 (compared to aspect ratios of 4:1 of the building block 500 and 2:2 of the building block 600) and the tubular portions (or the mating protrusions) are distributed on a regular 4×2 matrix (compared to a regular 4×1 array of building block 500 and a regular 2×2 matrix of building block 600). In practical terms, the building block 800 can be considered as formed from two pieces of building block 500 by merging the long sides together with longitudinal ends aligned, or formed by two pieces of building block 600 by merging corresponding sides together with corresponding ends aligned. As features of the building block 800 are otherwise identical to that of the building blocks 500 and 600, the descriptions above in relation to the building blocks 500 and 600 are incorporated herein by reference with numerals on the same or equivalent features added by 300 and 200 respectively and applied mutatis mutandis.

While the above examples have been made with reference to building blocks having upper mating protrusions and corresponding receptacles arranged in various array or matrix arrangements, it will be appreciated that the mating protrusions and the corresponding receptacles can be arranged in any regular m×n matrix, where m and n can be any integers, by combining the various building blocks described herein without loss of generality. Moreover, while a single helical thread has been used as an example of a threaded portion, it will be appreciated that multiple helical threads can be deployed.

Building blocks of the type mentioned above are commonly used for assembly into a variety of structures. A structure constructed from such building blocks is typically assembled from a plurality of building blocks by interconnecting building blocks both laterally and vertically. When assembling a structure from building blocks with complementary mating surfaces, such as building blocks comprising complementary or compatible upper and lower mating portions as described above, the building blocks are assembled such that the upper mating portion of one building block is fully inserted into the lower mating portion of another building block, thereby resulting in friction engagement between adjacent building blocks when counterpart mating portions are in engagement. However, such interconnection is merely by friction engagement and is not entirely secure.

Figure 9:
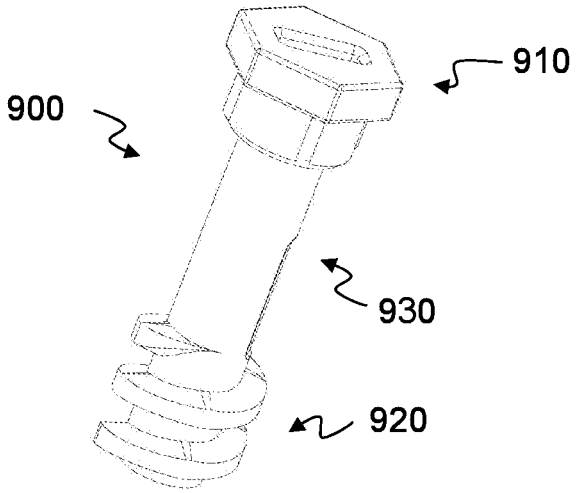
FIGS. 9 and 9A are respectively perspective and side views of a first example building block fastener.
Figure 9A:
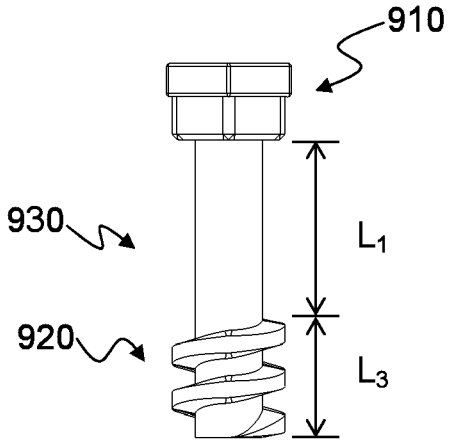

To facilitate interlocking of building blocks beyond mere frictional engagement and thereby enhancing structural integrity or stability, a building block fastener 900 as depicted in FIGS. 9 and 9A is provided. The building block fastener 900 comprises a head portion 910, an end portion 920, and a shaft portion 930 which interconnects the head portion and the end portion. The building block fastener is adapted such that, in use, the head portion 910 is anchored on a first portion on a first (source) building block, the end portion 920 is anchored on a second portion on a second (destination) building block, and the shaft portion 930 extends between the first portion on a first building block and the second portion on the second building block unrestrained by a building block.

The head portion 910 of the fastener is adapted to anchor on or press against a first building block during use, and comprises a boss portion having a transverse extent which is adapted to be stopped by the cylindrical wall of the tubular portion of the source building block to prevent the boss portion to move through the tubular portion during interlocking process. The boss portion comprises a circumferentially extending flange which is adapted to sit on and act against the top end of the cylindrical wall during use when the head portion of the fastener is anchored on the building block comprising that cylindrical wall. When the head portion 910 is anchored on the first building block, it only acts against the first building block by compression, and does not enter into threaded or other locked engagement with the first building block.

The shaft portion 930 comprises an elongate shaft body which is adapted to pass through the first and the second building blocks unrestrained or unengaged with by the building blocks. As the narrowest passageway inside a tubular portion is determined by the clearance defined by the helical threads of a fastener anchoring device, the elongate body of the shaft portion 930 has a dimension which permits the shaft portion to traverse through the narrowest passageway freely and unfettered. In this example, the shaft portion 930 is cylindrical and has a uniform cross section throughout its length, and the cross section of the shaft portion 930 is adapted such that the shaft portion is cleared of the building blocks through which the shaft portion 930 will pass. On the other hand, the diameter of the shaft portion 930 is only slightly less than the necessary clearance diameter to facilitate a sufficiently strong fastener. As the shaft portion 930 would need to pass through the first building block (on which the head portion of the fastener is anchored unfettered or) unrestrained, the length $L_1$ of the shaft portion must be long enough to bypass the fastener anchoring device on the first building block when the head portion 910 is anchored on the first building block. On the other hand, the length ($L_3$) of the threaded portion 920 of the fastener would be adapted such that the total length ($L_1+L_3$) of the shaft body portion 930 and the threaded portion 920 must be sufficient for a helical thread on the threaded portion 920 to enter into engagement with the fastener anchoring device on the second or destination building block with the possibility of further tightening when the head portion 910 is anchored on the first building block. In order that the threaded portion 920 does not get entangled or engaged with the fastener anchoring device on a building block other than the second or destination building block, the length $L_3$ would be sufficient for 2-3 turns of helical threads.

The end portion 920 comprises an engagement means which is adapted for making releasable engagement with a fastener anchoring device formed on the second destination building block and for. As the end portion 920 is adapted to engage with a fastener anchoring device formed inside the tubular portion of the destination building block to facilitate anchoring, the end portion 920 is free to slide into and out of the tubular portion but is obstructed by the fastener anchoring device, while the engagement means can move into the fastener anchoring device upon rotary negotiation therewith.

In this example, the engagement means is adapted for making screw-type engagement with the threaded portion (146, 246, . . . , 846) of the fastener anchoring device formed inside the through bore of the upper mating protrusion (142, 242, . . . , 842) and comprises a threaded portion having a plurality of helical threads compatible to the helical thread on the fastener anchoring device. The helical threads on the threaded end portion 920 projects from a shaft body portion having the same cross-section as the shaft portion 930. In this example, the fastener 900 is integrally moulded of hard plastics and the helical threads are formed at one go.

The pitch on the threaded portion 920 is the same as that of the corresponding threaded portion (146, 246, . . . , 846) inside the through bore of the upper mating protrusion as formed by the tubular portions (142, 242, . . . , 842) to facilitate complementary threaded engagement. The engagement means of the fastener is adapted for making closely fitted engagement with the internal thread formed on the inside of the internal bore of the upper mating protrusion of a destination building block. To facilitate closely fitted engagement of the fastener with the fastener anchoring device on the destination building block, the major diameter of the threaded portion on the engagement means of fastener is larger than the clearance diameter defined by the helical threads on the tubular portions of the building blocks, and is equal or only slightly smaller than the diameter of the through bore defined by the cylindrical wall defining a tubular portion. Likewise, the minor diameter of the threaded portion on the fastener is equal or only slightly smaller than the minor diameter of the internal threads of the fastener anchoring device.

Figure 10:
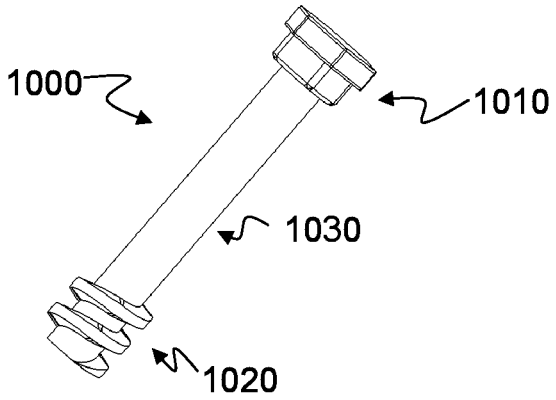
FIGS. 10 and 10A are respectively perspective and side views of a second example building block fastener.
Figure 10A:
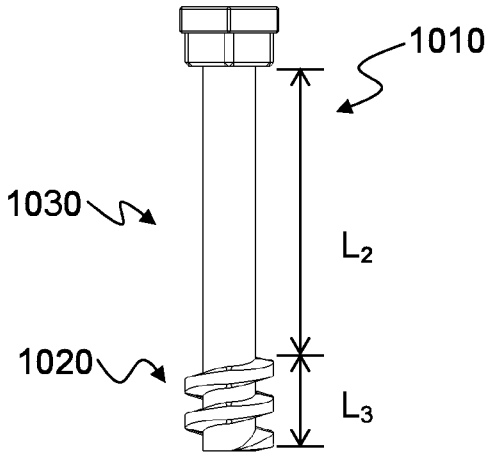

A building block fastener 1000 depicted in FIGS. 10 and 10A is an elongated version of the fastener 900 in which the length of the shaft portion ($L_2$) is substantially longer than $L_1$. More specifically, the difference in length ($L_2-L_1$) would be equal to a multiple (n) of the separation distance between the threaded portions of two immediately stacked building blocks, where n is an integer, say between 1 and 10. With a fastener having a longer shaft body, one or a plurality of building blocks in mated coupling can be inserted between a first (source) building block on which the head portion 1010 of the fastener is anchored and a second destination building block on which the end portion 1020 of the fastener is anchored. The features of the fastener 1000 are otherwise identical to that of the first example fastener 900, and the descriptions above in relation to the fastener 900 are incorporated herein by reference with numerals on the same or equivalent features added by 100 for succinctness.

A building block fastener 1000 depicted in FIGS. 10 and 10A comprises a head portion 1010, an end portion 1020, and a shaft portion 1030 interconnecting the head and end portions. Instead of helical threads, the end portion 1020 comprises a plurality of radial projecting studs distributed on the periphery on the end portion of the fastener. As the features of the fastener 1000 are otherwise identical to that of the first example fastener 900, the descriptions above in relation to the fastener 900 are incorporated herein by reference with numerals on the same or equivalent features added by 200 for succinctness.

In another fastener example (not shown), the head portion of the fastener is adapted such that it is receivable inside the bore of the tubular portion of a source building block but obstructed by a fastener anchoring device inside the tubular portion. In this arrangement, the head portion may be flush with or below the cylindrical wall and the head portion is also anchored on the fastener anchoring device on the first building block, although by compression only and without threaded engagement. The example fasteners described are integrally moulded of hard plastics with the helical threads projecting from a shaft body portion having a transverse dimension equal to the minor diameter of the helical threads.

It will be appreciated that the fasteners can made of metal or other mouldable materials without loss of generality.

FIGS. 12, 12A to 12D depict an example structure 1180 comprising three building blocks (800, 600, 200) interlocked by fasteners (900, 1000). In this example, a 2×1 building block 200 of FIG. 2 having two tubular portions in-line is stacked on a 2×2 building block 600 of FIG. 6 and in mated coupling. The 2×2 building block 600 having four tubular portions arranged in a 2×2 regular matrix is stacked on a 4×2 building block 800 of FIG. 8 having eight tubular portions arranged in a 4×2 regular matrix and also in mated coupling. When two building blocks are stacked in mated coupling to form part of a structure in the present context, the upper mating portion (comprising the mating protrusions) of the building block below is fully received by the lower mating portion (comprising the receptacles) of the building block above in a closely fitted manner. When this occurs, the bottom edge of the peripheral skirt of the building block above is resting squarely on and supported by the upper surface of the base panel of the building block below.

Figure 12:
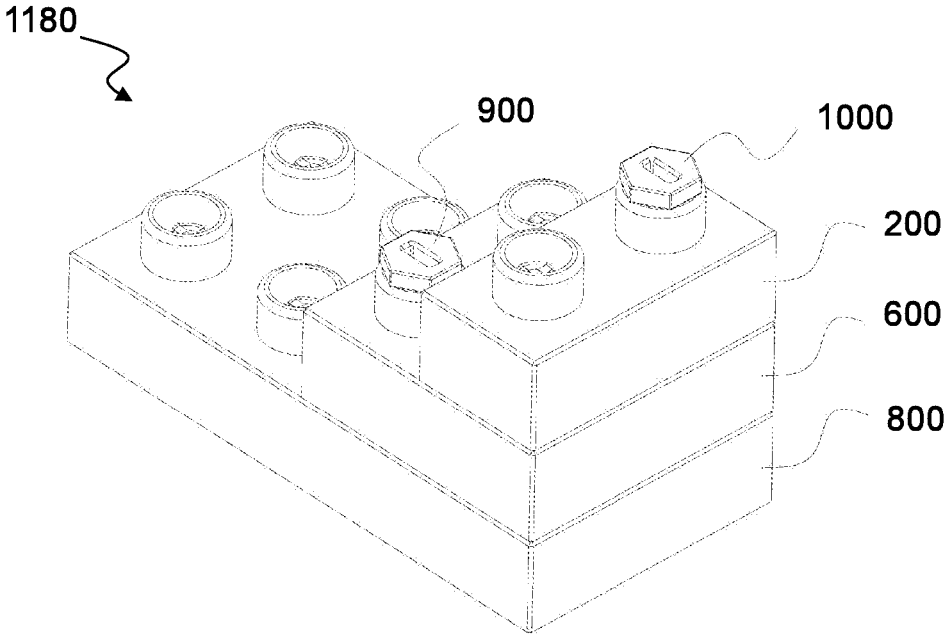
Figure 12A:
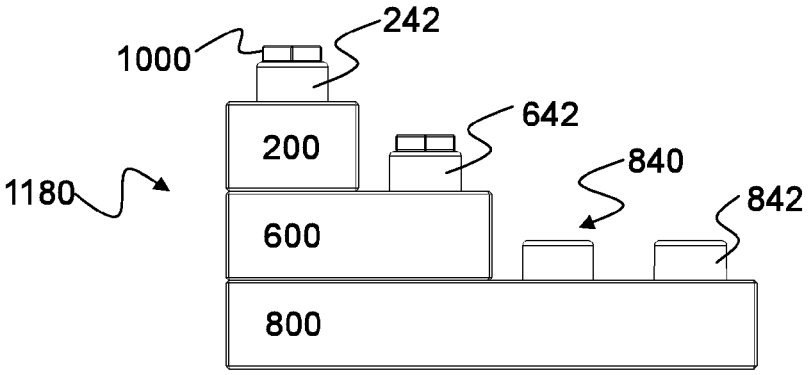
Figure 12B:
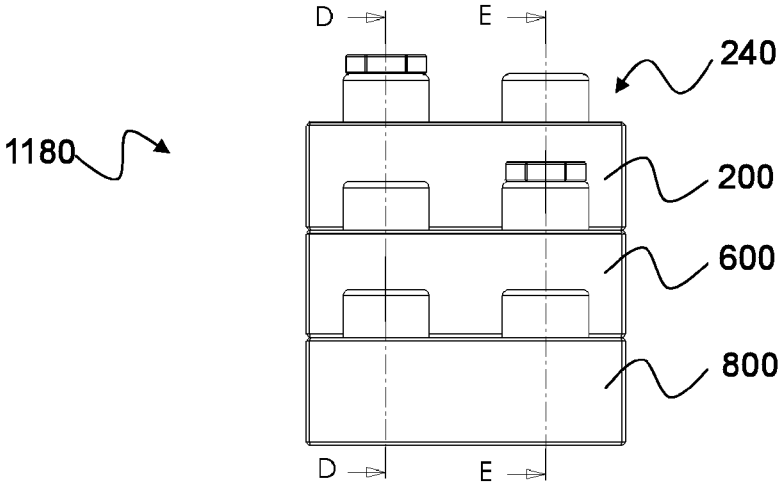
Figure 12C:
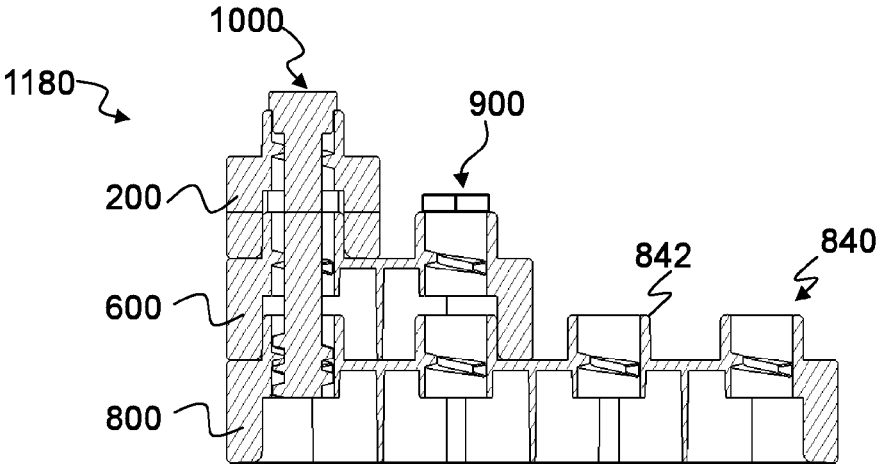

As shown in FIGS. 12C and 12D, a fastener 1000 is used to bring about fastened interlocking between the stacked building blocks 200, 600 and 800 while another fastener 900 is used to bring about fastened interlocking between the stacked building blocks 600 and 800.

As depicted in FIG. 12D, the head portion of the fastener 900 is anchored on the building block 600 compression against the cylindrical wall, with the circumferential flange on the head portion 910 resting squarely on the top end of the cylindrical wall 642 of the tubular portion 640. The end portion 920 of the fastener 900 is engaged with the building block 800 below by means of threaded engagement between a second helical thread on the end portion 920 of the fastener 900 and the helical thread 846 on the building block 800. In addition, the shaft portion 930 of the fastener 900 passes through the threaded portion 646 on the fastener anchoring device of the building block 600 unengaged or unrestrained.

As depicted in FIG. 12C, the head portion of the fastener 1000 is anchored on the building block 200, with the circumferential flange on the head portion 1010 resting squarely on the top end of the cylindrical wall 242 of the tubular portion 240. The end portion 1020 of the fastener 1000 is engaged with the building block 800 below by means of threaded engagement between a second helical thread on the end portion 1020 of the fastener 1000 and the single helical thread 846 on the building block 800. In addition, the shaft portion 1030 of the fastener 900 passes through the threaded portions 246 and 646 the two building blocks 200 and 600 unengaged or unrestrained.

Application of the building block fasteners to bring about tightened interlocking of building blocks will be described below.

After the three building blocks (800, 600, 200) have been stacked with adjacent building blocks in mated coupling, a user will apply the fastener 900 to lock the building blocks 600 and 800 by inserting the end portion 920 into the aperture 644 of the tubular portion 640. When the radial projecting thread on the end portion 920 of the fastener 900 encounters the threaded portion 646 of the building block 600 in the course of the axial insertion, a user will need to turn the fastener about its shaft axis to negotiate with and overcome the threads of the threaded portion 646 of the building block 600 to make further axial advancement towards the next building block 800, since the threaded engagement means on the end portion of the fastener 900 exceeds the clearance aperture inside the tubular portion. After the threaded end portion 920 has passed through the threaded portion 646 of the building block 600, the shaft portion 930 of the fastener 900 is free to slide and/or rotate relative to the threaded portion 646 and move towards the building block 800 until the threaded portion 846 of the building block 800 on the first layer is encountered. When this occurs, a user need to rotate the fastener 900 about its shaft axis to make threaded engagement with the helical thread 846 on the building block 800 to bring about interlocking between the two building blocks 600 and 800. A user can elect to tighten the interlocking between the two building blocks 600 and 800 further by rotating the fastener further after threaded engagement has been made. In this example, the fastener 900 traverses through the two building blocks but is in threaded engagement only with a single building block, namely, building block 800.

Similarly, a user will apply the fastener 1000 to fasten the mated coupling of the three building blocks 200, 600 and 800. To bring about locked interconnection of the building blocks, a user will firstly insert the end portion 1020 of the fastener 1000 axially into the aperture 244 on the tubular portion 240 of the building block 200. When the radial projecting thread on the end portion 1020 of the fastener 1000 encounters the threaded portion 246 of the building block 200 in the course of the axial insertion, a user will need to turn the fastener 1000 about its shaft axis to overcome the threads of the threaded portion 246 of the building block 200 in order to make further axial advancement towards the next building block 600. After the threaded end portion 1020 of the fastener 1000 has passed through the threaded portion 646 of the building block 600, the shaft portion 1030 of the fastener 1000 is free to advance towards the building block 800 by sliding axially relative to the threaded portion 646 until the threaded portion 846 of the building block 800 on the first layer is encountered. The user will then turn the fastener 1000 about its shaft axis again to overcome the threads of the threaded portion 846 of the building block 800 in order to make threaded engagement with the threaded portion 846 of the building block 800 to anchor on the building block 800. In this example, the fastener 1000 traverses through all the three building blocks but is in threaded engagement only with a single building block, namely, building block 800. The head portion 1010 acts against the building block 200 by compression to tighten interlocking. In addition, the fastener 1000 is not restrained by the building block 600 which is intermediate the building blocks 200 and 800.

Figure 11:
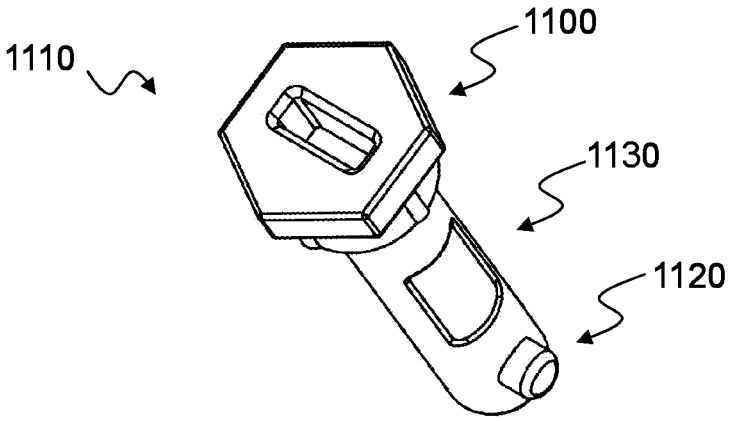
FIGS. 11 and 11A are respectively perspective and side views of a third example building block fastener.
Figure 11A:
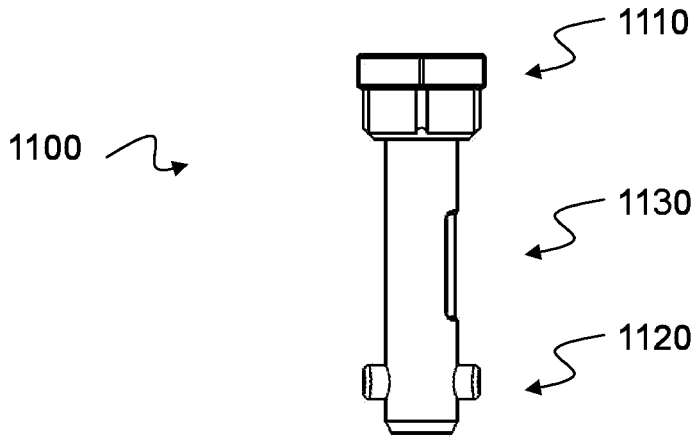

In an alternative example, the fastener 1000 can be replaced by another fastener 900 so that the assembly comprising the three building blocks 200, 600, and 800 can be fastened by two identical fasteners 900 of FIG. 9. In this alternative example, a first fastener 900 will be used to fasten building blocks 200 and 600, and a second fastener 900 will be used to fasten building blocks 600 and 800, thereby bring about locked interlocking of all the three building blocks.

Where a fastener 1110 of FIG. 11 is used, for example, to form an assembly 1190 comprising building blocks 800 as depicted in FIGS. 13 and 13A, the application is substantially identical except that the reference to 'threaded end portion' of the fastener will be replaced by the expression 'stud end portion' of the fastener 1100 without loss of generality and the above descriptions in relation to the application of the fasteners are incorporated herein by reference.

Figure 8:
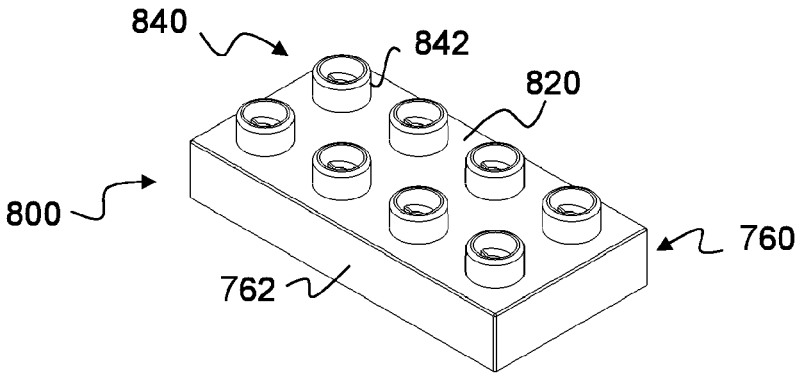
FIGS. 8, 8A to 8D are respectively the top plan view, the bottom plan view, and cross-sectional views along lines AA and BB of FIG. 8A of a eighth example building block.
Figure 8A:
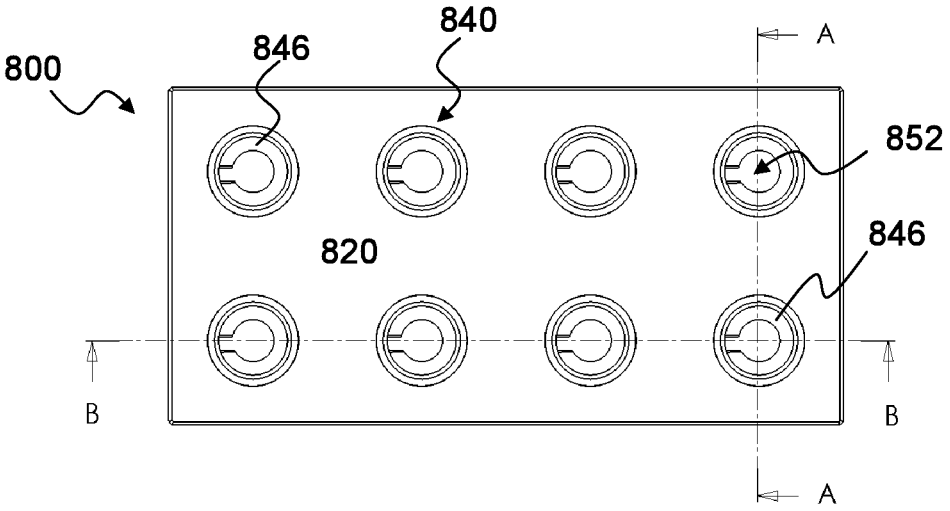
Figure 8B:
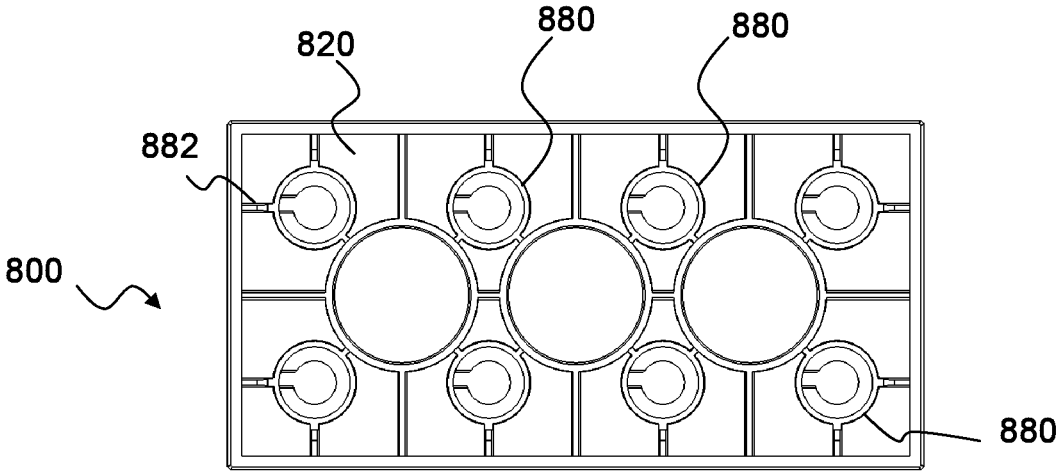
Figure 8C:
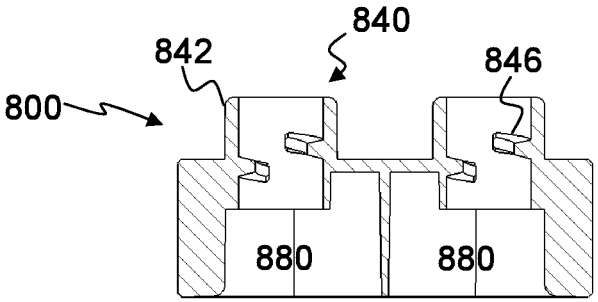
Figure 8D:
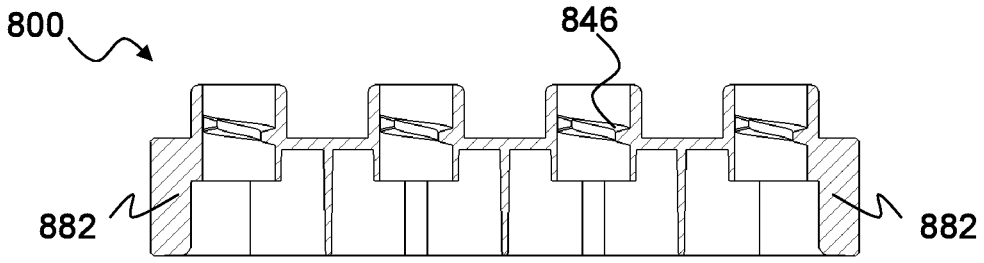

A stack of building blocks 1190 of FIG. 13 comprises a first building block 800-1 on which there is stacked a second building block 800-2 to form an example of a sub-assembly of a building block structure. The first and second building blocks are stacked such that the upper mating portion of the first building block 800-1 is totally received by the lower mating portion and surrounded by the peripheral skirt of the second building block. The lower mating portion of the building block 800 comprises 8 mating receptacles 880 arranged into a regular 2 row×4 column matrix as depicted in FIG. 8B. As depicted in FIG. 13C, 4 pieces of fasteners 1100-1 to 1100-4 are used to interlock the first building block 800-1 and the second building block 800-2, thereby leaving half of the upper mating protrusions on the second building block 800-2 un-occupied by inter-block fasteners. The 4 fasteners 1100-1 to 1100-4 are arranged such that there are two fasteners in each row and there is only one fastener in each column to more evenly distribute interlocking forces of the fasteners.

A third building block 800-3 is stacked on the sub-assembly 1190 in the same manner as the second building block 800-2 is stacked on the building block 800-1 after the sub-assembly comprising the building blocks 800-1 and 800-2 has been formed. Four fasteners 1100-5 to 1100-8 are used to lock the third building block to the sub-assembly 1190. The four fasteners 1100-5 to 1100-8 are inserted into the through bore of the four upper mating protrusions of the third building block 800-3 in order to engage with the fastener anchoring devices formed on the upper mating protrusions of the building block 800-2 immediately below. To meet this requirement, the fasteners are inserted into the four upper mating protrusions of the third building block 800-3 which correspond to the four upper mating protrusions of the second building block 800-2 not occupied by the four fasteners 1100-1 to 1100-4 as depicted in FIG. 13C. The four fasteners 1100-5 to 1100-8 are then locked with the second building block by engaging with the un-occupied fastener anchoring devices formed thereon to form a building block assembly comprising 3 building blocks in a stack.

Figure 13B:
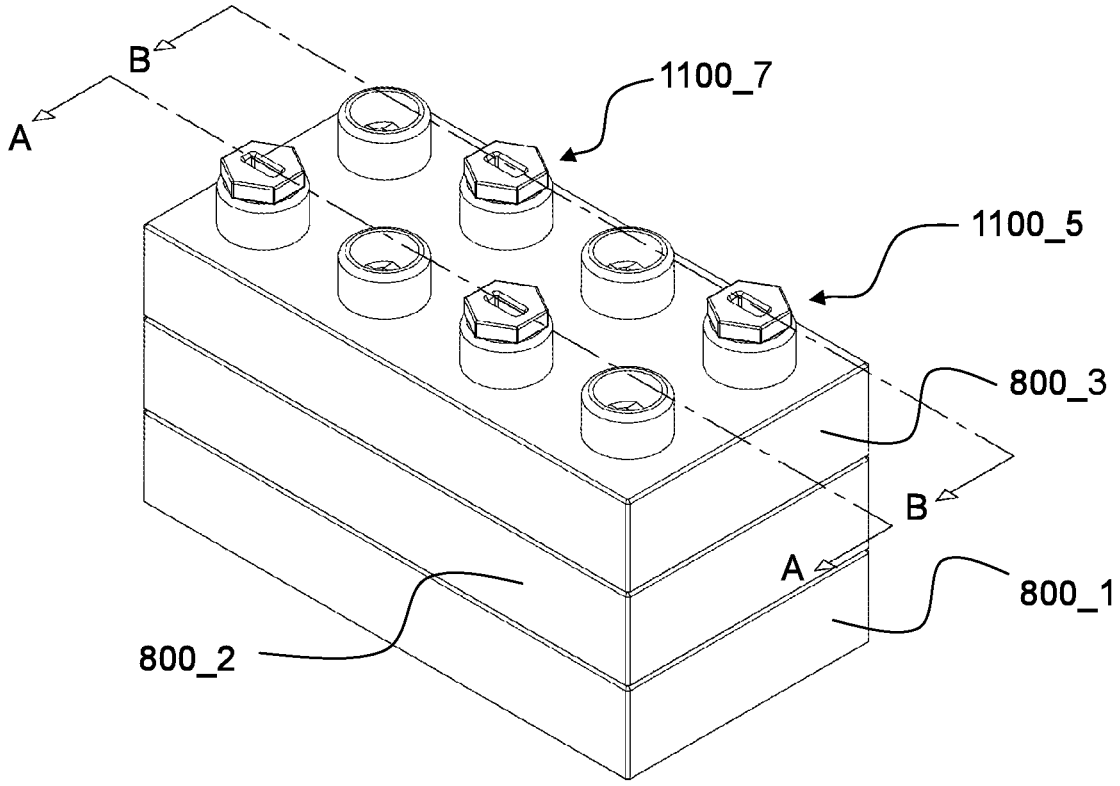
FIG. 13B is a perspective view depicting an assembly of building blocks comprising the two interlocked building blocks of FIG. 13.
Figure 13C:
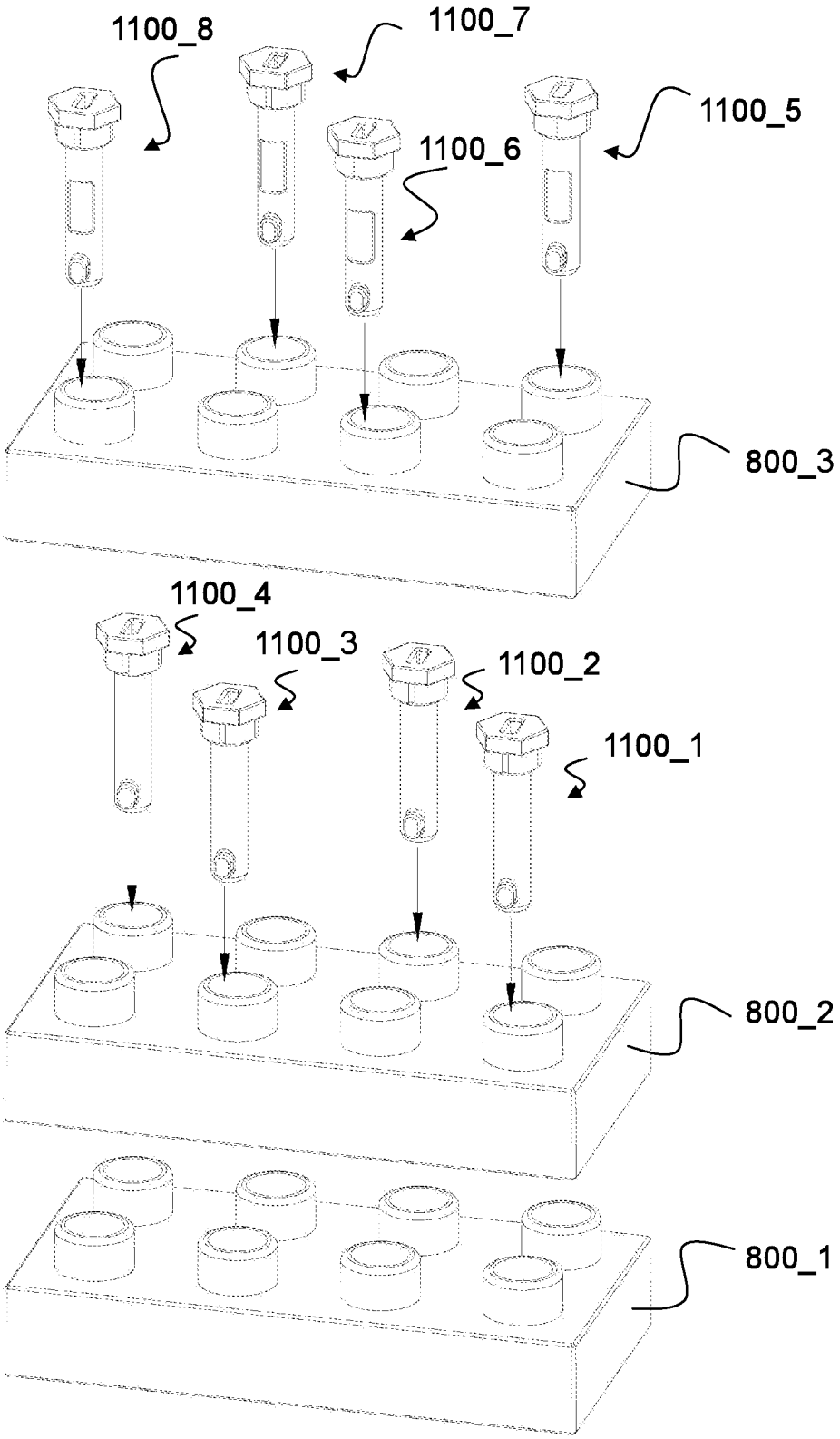
FIG. 13C is an exploded view depicting the assembly of FIG. 13B, FIGS. 13D and 13E are respectively cross-sectional views along lines A-A and BB of FIG. 13B.
Figure 13D:
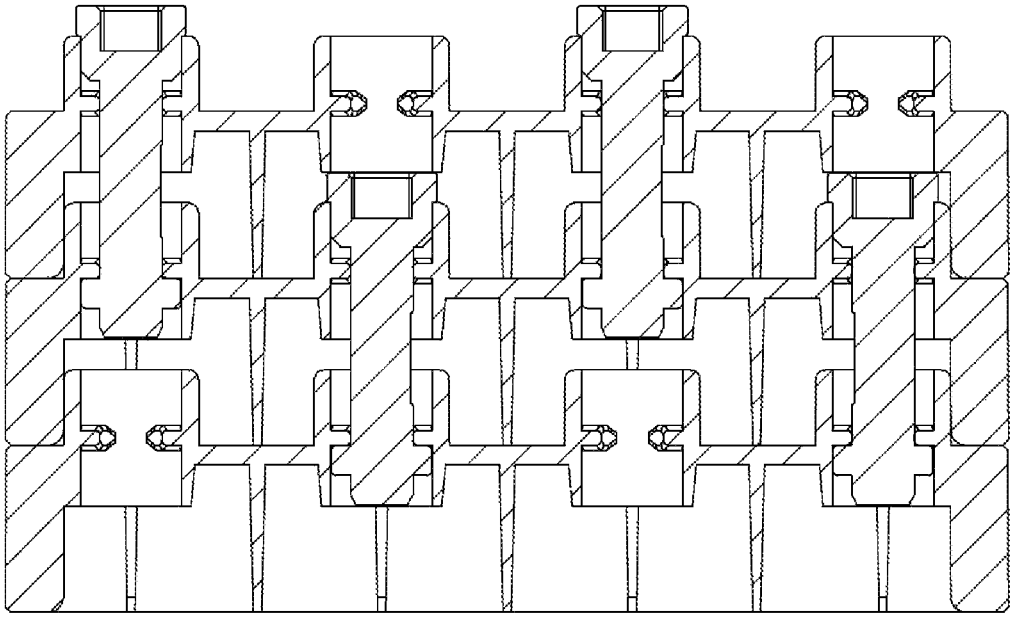
FIGS. 13 and 13A are respectively perspective and cross-sectional views depicting two building blocks interlocked by a fastener of FIG. 11.
Figure 13E:
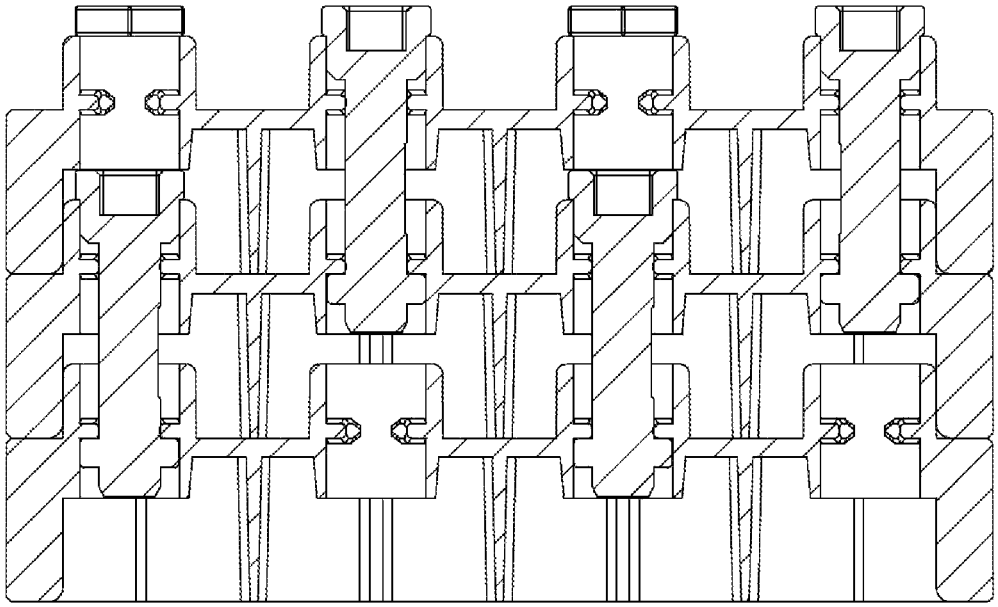

As depicted in FIGS. 13D and 13E, the head portion of the fasteners 1100-1 to 1100-4 protrudes above the upper mating protrusion of the building block and the protruding portion of the fastener above the second building block 800-2 is adapted such that it is well received by the mating receptacle and does not push against the top of the mating receptacles of the building block 800-3 when in interlocking.

While the fastener 1100 of different shaft portion lengths has been used to illustrate interlocking of the building blocks 800-1 to 800-3, it will be appreciated that the fastener 900 and its longer shaft version 1000 can also be used interchangeably without loss of generality.

Where the head portion of the fasteners 900, 1000, and 1100 is adapted to be receivable inside the tubular portion and retained by the internal thread on the internal bore, the head portions will not protrude above the corresponding upper mating protrusions, and this can be preferred for some applications.

While 8 fasteners are used to illustrate interlocking of the assembly comprising the three 2×4 building blocks of FIG. 13B, it will be appreciated that a smaller number of fasteners can be used. For example, two fasteners 1100 may be inserted into the upper mating protrusions at diagonal ends of the building block 800-2 for interlocking with building block 800-1 and another two fasteners 1100 for interlocking between building blocks 800-2 and 800-3 may occupy the remaining upper mating protrusions at other diagonal ends of the building block 800-2 to distribute fastening forces.

Where fasteners having different length of shaft portions are used, for example, fasteners having a shaft portion long enough to interlock the first 800-1 and the third 800-3 are used in combination with fasteners having a shaft portion long enough to interlock the first 800-1 and the second 800-2 building blocks, a smaller number of fasteners can be used and the distribution of fasteners can be selected to meet tension and/or loading requirements.

Furthermore, while 3 identical building blocks are used in FIG. 13B to illustrate an example structure of building blocks, it will be appreciated that building blocks comprising different arrays or matrixes of upper mating protrusions can be used in combination without loss of generality. In addition, it will be appreciated that because the head portion of a fastener is located axially underneath the through bore of an upper mating protrusion of a building block immediately above, the head portion can be accessed from above for tightening and loosening interlocking. For example, the building block 800-1 can be released or tightened from the assembly of FIG. 13B by accessing through the tubular portions of the building block 800-3 and without first removing the building block 800-3.

Figure 14:
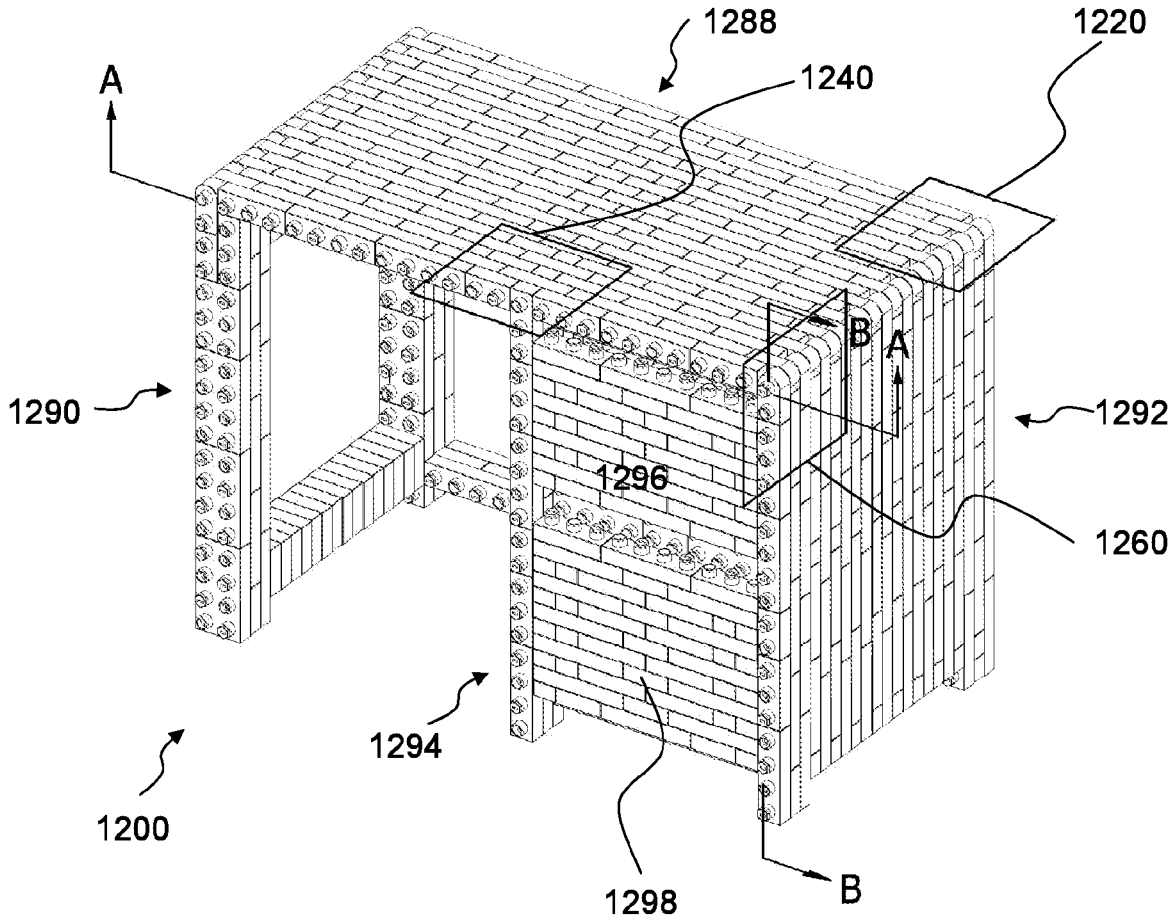
FIG. 14 is a perspective view depicting a desk assembled from a plurality of building blocks.

A desk 1200 depicted in FIG. 14 is an example modular structure which is constructed from building blocks and fasteners according to the present disclosure. The desk, as an example of furniture, comprises a desk top surface 1288, a left support 1290, a right support 1292, a center support 1294, an upper drawer 1296 and a lower drawer 1298.

The desk top surface is assembled from a plurality of 2×1 building blocks 300 having a rounded end, a plurality of 3×1 building blocks 400, and a plurality of 4×1 building blocks 500. The horizontal desk top surface is collectively formed by the elongate side panels 362, 462, 562 of the peripheral skirts of the building blocks except when there is a transitional interconnection. Where there is a transitional interconnection, the portion of the transitioning part contributing to the desk top surface is due either to the short side panel or the rounded side panel of the building blocks. There are two types of transitional interconnection in the desktop surface, namely, a first type which forms an L-shaped transitional interconnection with a rounded corner, and a second type which forms a T-shaped transitional interconnection.

The first type of transitional interconnection is a rounded edge formed at an extreme end of the desktop surface. This transitional interconnection is to facilitate rounded transition from an edge portion of a horizontal surface of the desktop to a vertical support. The edge portion is collectively formed by a plurality of building blocks 300 which are assembled such that the longitudinal axes of adjacent building blocks 300 are orthogonal to each other to facilitate an L-shaped transition from a horizontal desktop surface to a vertical support surface, for example, on the left or right support. The edge portion on the desktop surface is contributed by an ensemble of rounded side panels of the building blocks 300, which are also adapted to form a smooth edge.

The second type of transitional interconnection is a 'T'-shaped interconnection which is provided to form a 'T'-shaped transition from a horizontal desktop surface to a vertical support at a location intermediate the extreme edges of the desktop surface. The 'T'-shaped interconnection is collectively formed by a plurality of building blocks 400 which are assembled such that the longitudinal axes of adjacent building blocks 400 are orthogonal to each other to facilitate a T-shaped transition from a horizontal desktop surface to a vertical support surface, for example, on the center support.

In this second type interconnection, an upper mating protrusion on one elongate end of the building block is in mated coupling with an intermediate receptacle of an adjacent building block to form a 'T'-shaped transitional sub-assembly. An intermediate receptacle in the present context means a receptacle which is intermediate other receptacles such that there is at least one adjacent receptacle on each side of the intermediate receptacle on the same building block.

Figure 14A:
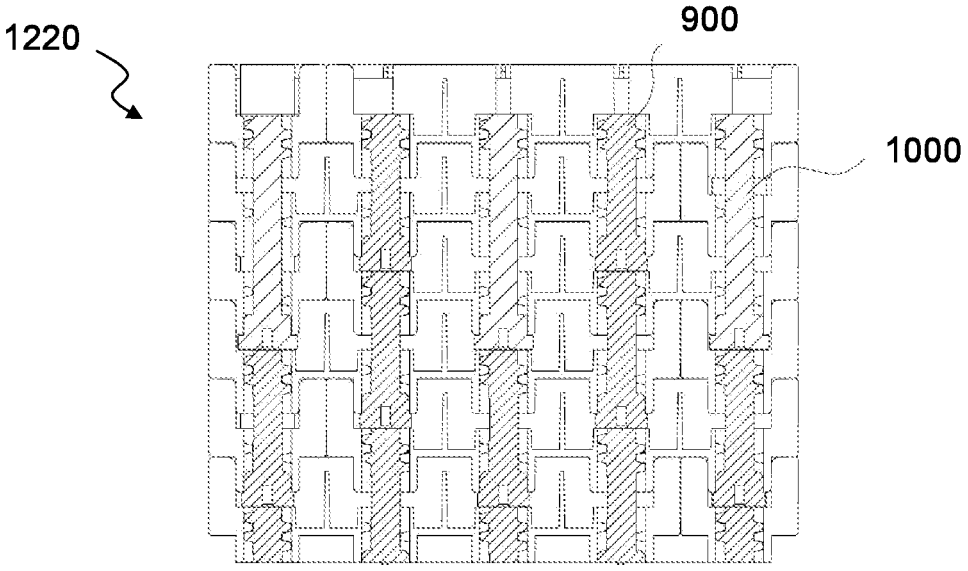
FIGS. 14A to 14C are enlarged sectional views of various portions of the desk of FIG. 14 taken along the section lines A-A, & B-B.

As shown more in FIG. 14A, alternate rows of the desktop forming building blocks are fastened directly to the rounded edge which forms part of the vertical support, and a row of the desktop forming building blocks not directly connected to the edge transition building blocks forming part of the vertical support are fastened onto an adjacent row of building blocks which is directly connected to an edge transition building block, thereby facilitating the formation of a robust desktop surface. Likewise, alternate rows of building blocks forming the 'T'-shaped transition are directly fastened onto non-transitional building blocks forming the desktop surface, and non-transitional building blocks are fastened together by a variety of fasteners as shown in the Figure.

Figure 14B:
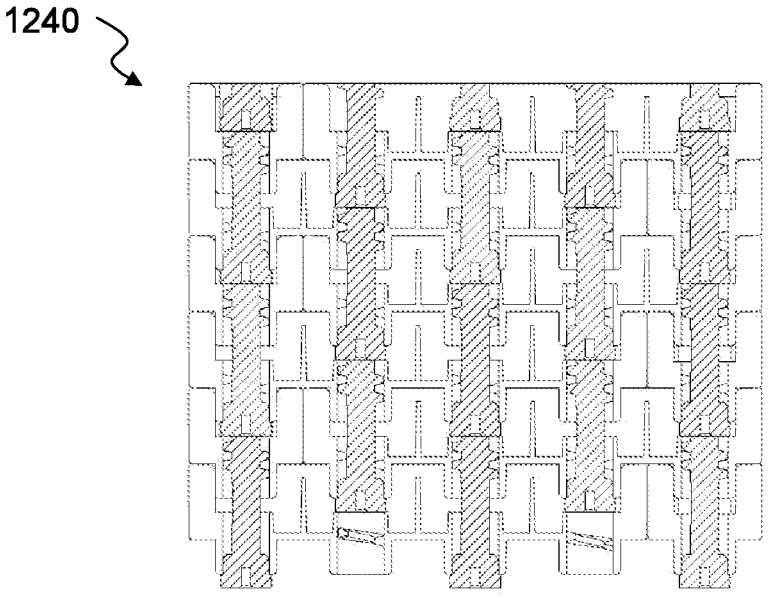
Figure 14C:
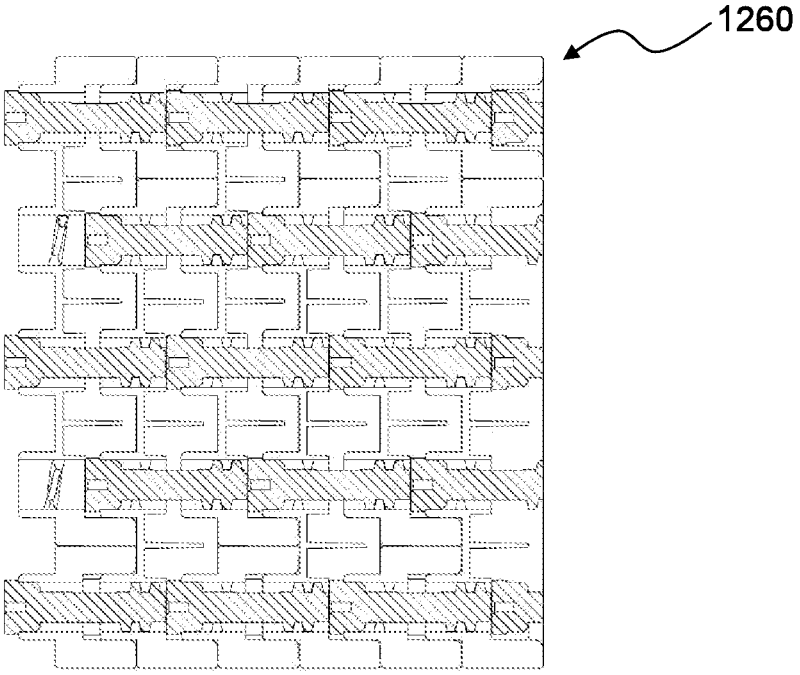
Figure 15A:
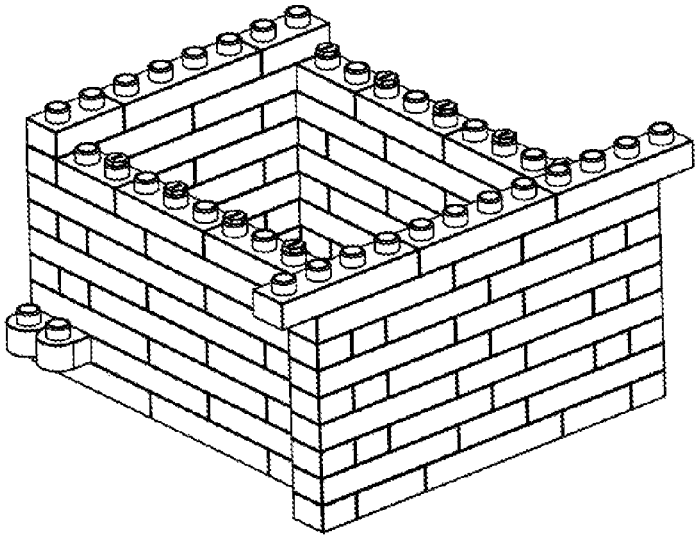
FIGS. 15A and 15B are front and rear perspective views of a drawer of the desk of FIG. 14, FIGS. 15C to 15L are perspective views depicting various layers of the drawer of FIGS. 15A and 15B, and FIGS. 16, 16A and 16B depict a first variation of building block interlocking.
Figure 15B:
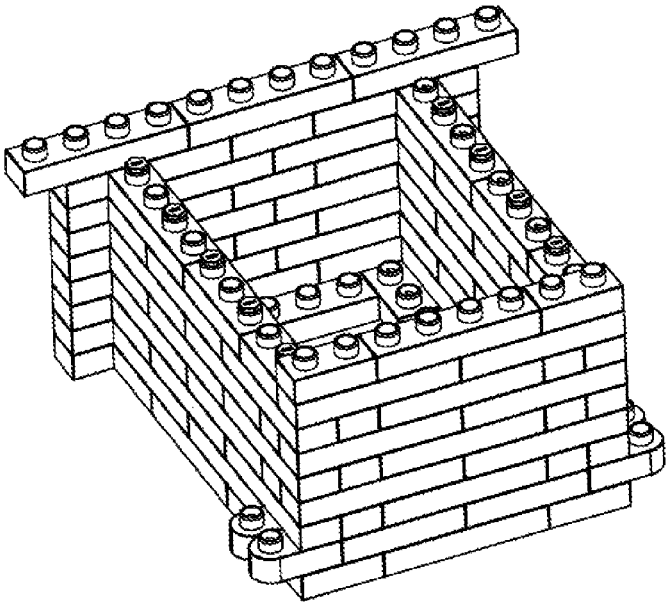
Figure 15C:
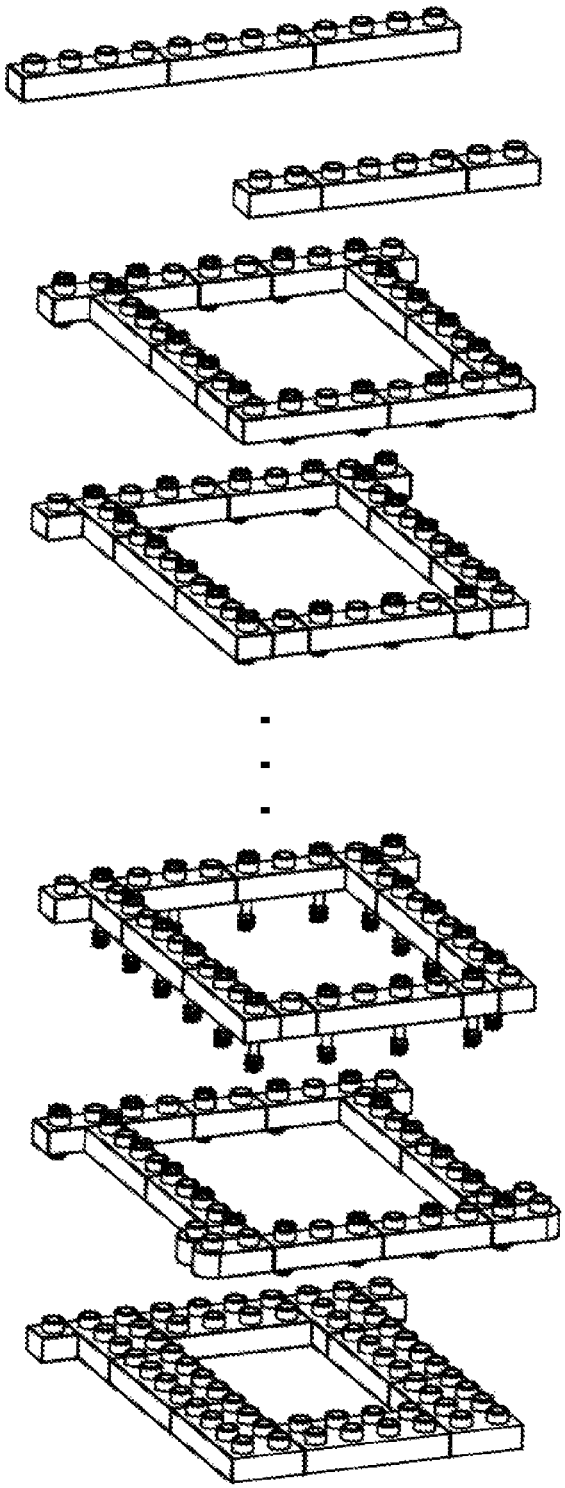
Figure 15D:
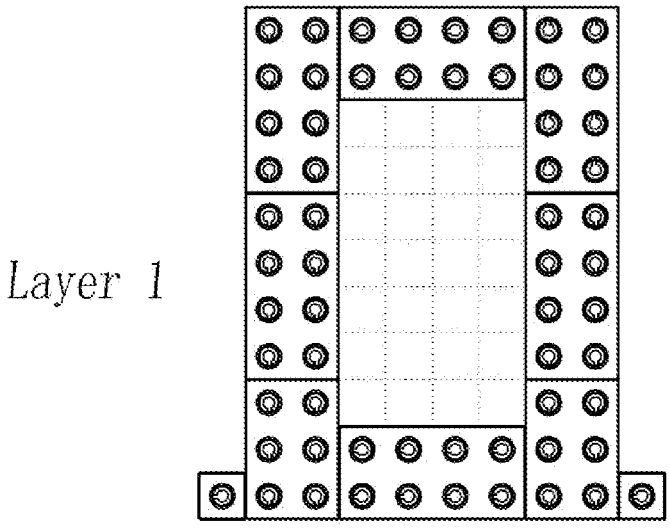
Figure 15E:
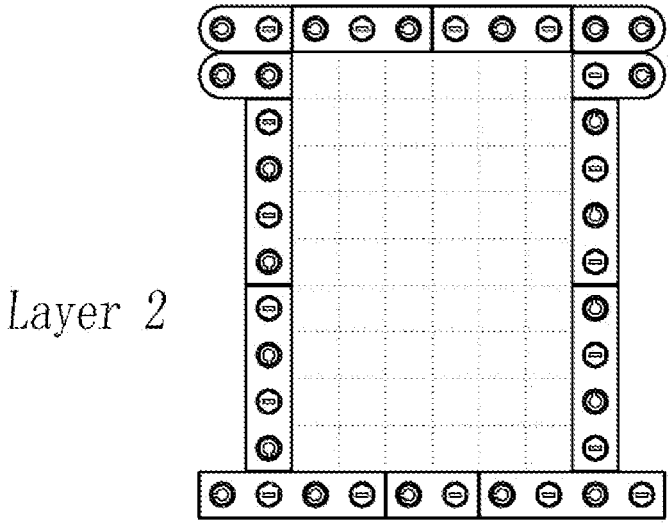
Figure 15F:
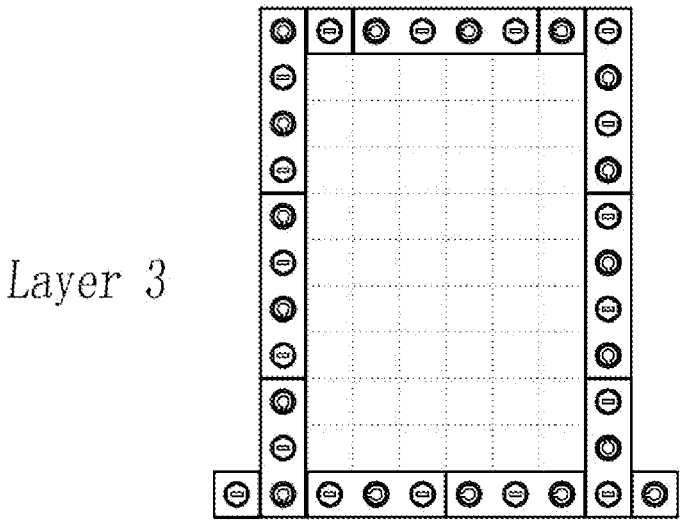
Figure 15G:
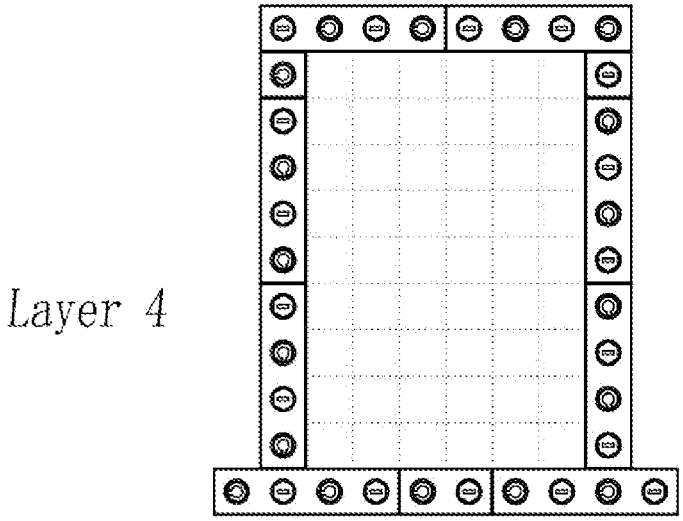
Figure 15H:
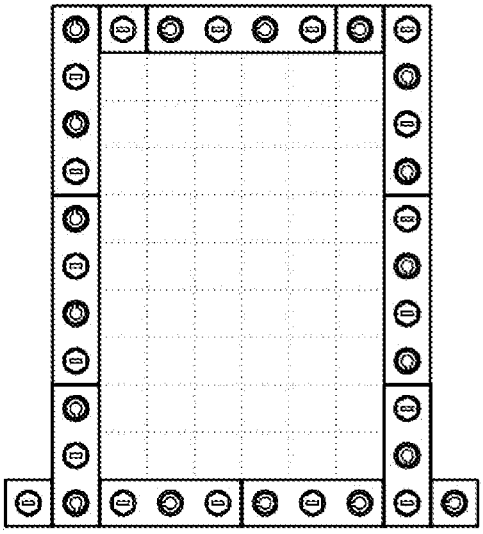
Figure 15I:
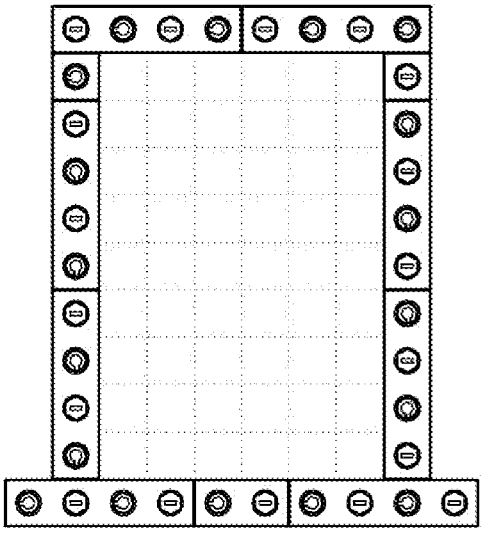
Figure 15J:
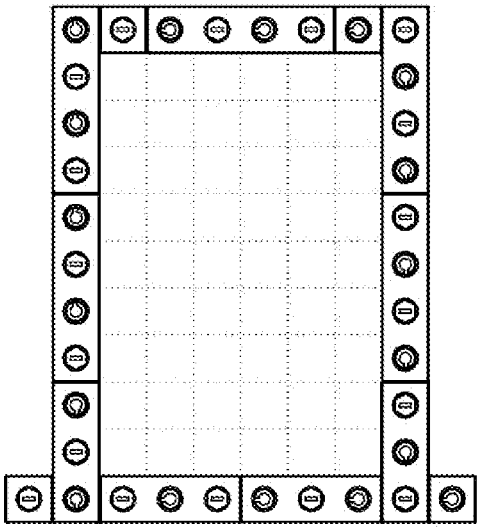
Figure 15K:
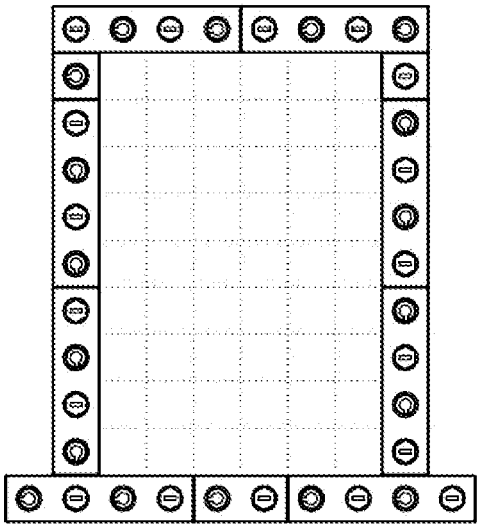
Figure 15L:
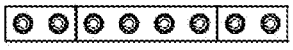
Figure 15L:
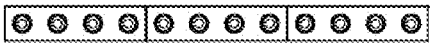

As shown in FIGS. 14A to 14C, building blocks forming various portions of the desk are connected by fasteners of different shaft portion lengths and at different locations to facilitate interlocking of building blocks in mated coupling to form a complex structure of FIG. 14.

FIGS. 15 to 15 L depict various layers of a drawer of the desk of FIG. 14 and the fasteners used to interconnect the various layers. It will be noted that from the drawer example that 3-dimensional structures with multiple orthogonally disposed building blocks can be assembled and interlocked by using the fastener and building blocks disclosed herein.

In an example, the desk may be configured such that the desktop surface is only hingedly connected at the rounded edge such that the desktop surface is moveable about a hinge defined by the round portions of the building blocks. In such a configuration, the desktop surface will not be fastened onto the central support or the other vertical supports. In addition, the fasteners would only made threaded engagement with building blocks having a horizontal flat side panel surface or with building blocks having a vertical flat side panel surface, but not both, in order to facilitate hinged movement of the desktop surface relative to the vertical support.

Figure 16:
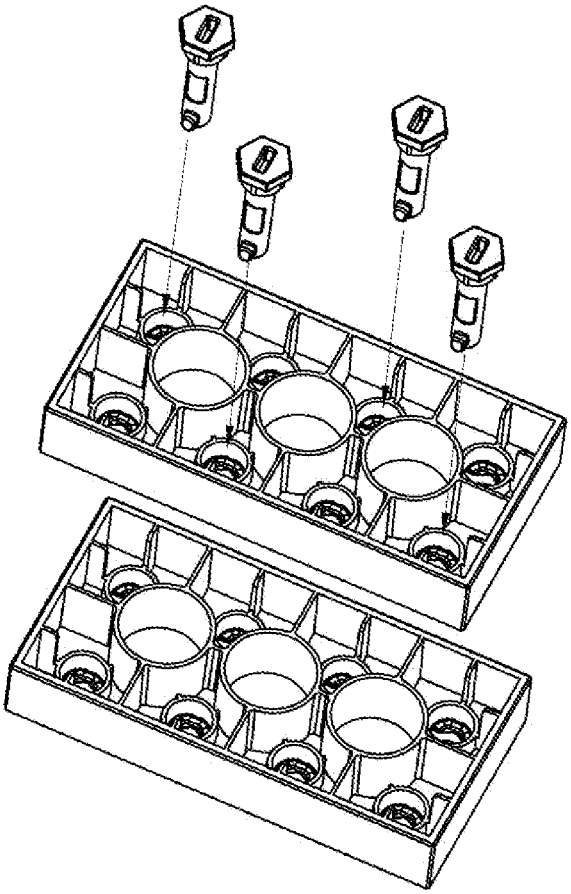
Figure 16A:
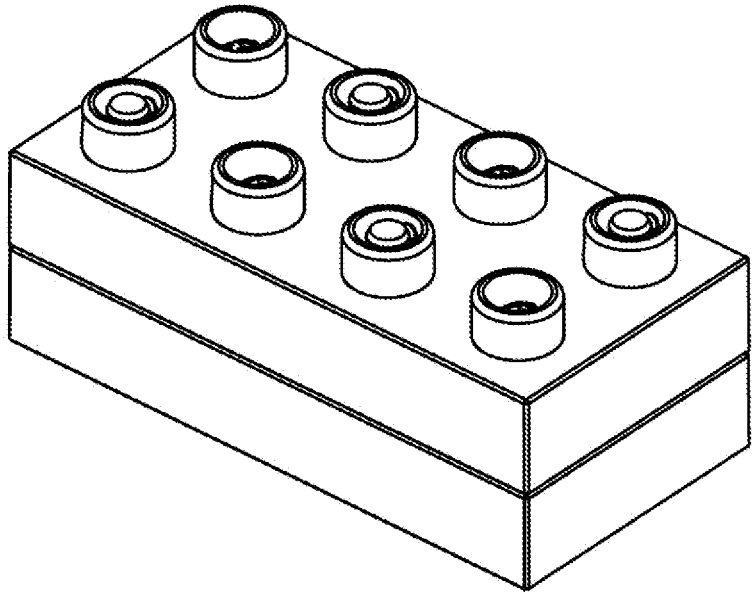
Figure 16B:
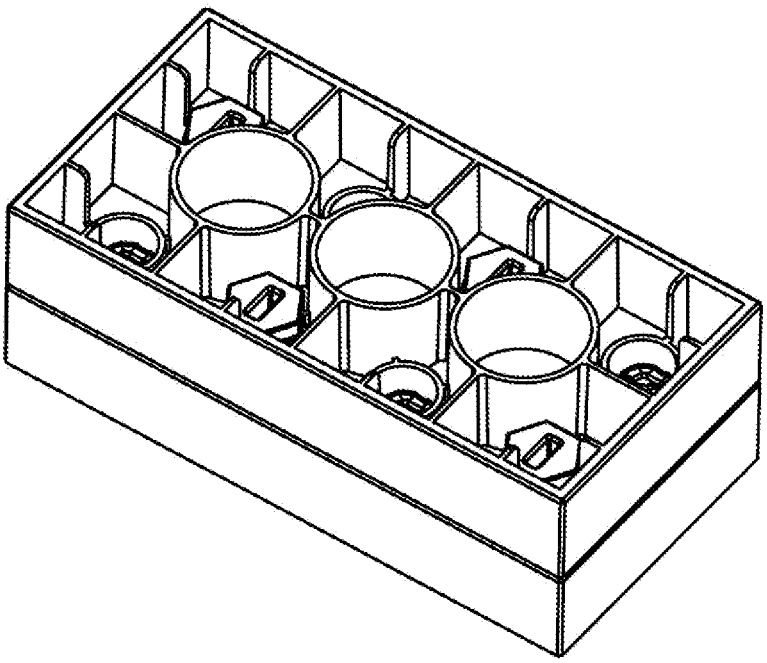

FIGS. 16 to 19 illustrate various variations of interconnection of the building blocks disclosed herein. In the assembly depicted in FIGS. 16, 16A and 16B, the building blocks are stacked in the same manner as that of FIG. 13, except that the fasteners are inserted from the side of the lower mating portion of a building block below for engagement with a fastener anchoring device on the building block above. As shown in FIG. 16B, the head portions of the fasteners are received in the mating receptacles, and the end portions of the fasteners are inside the tubular portions of the building block above.

Figure 17:
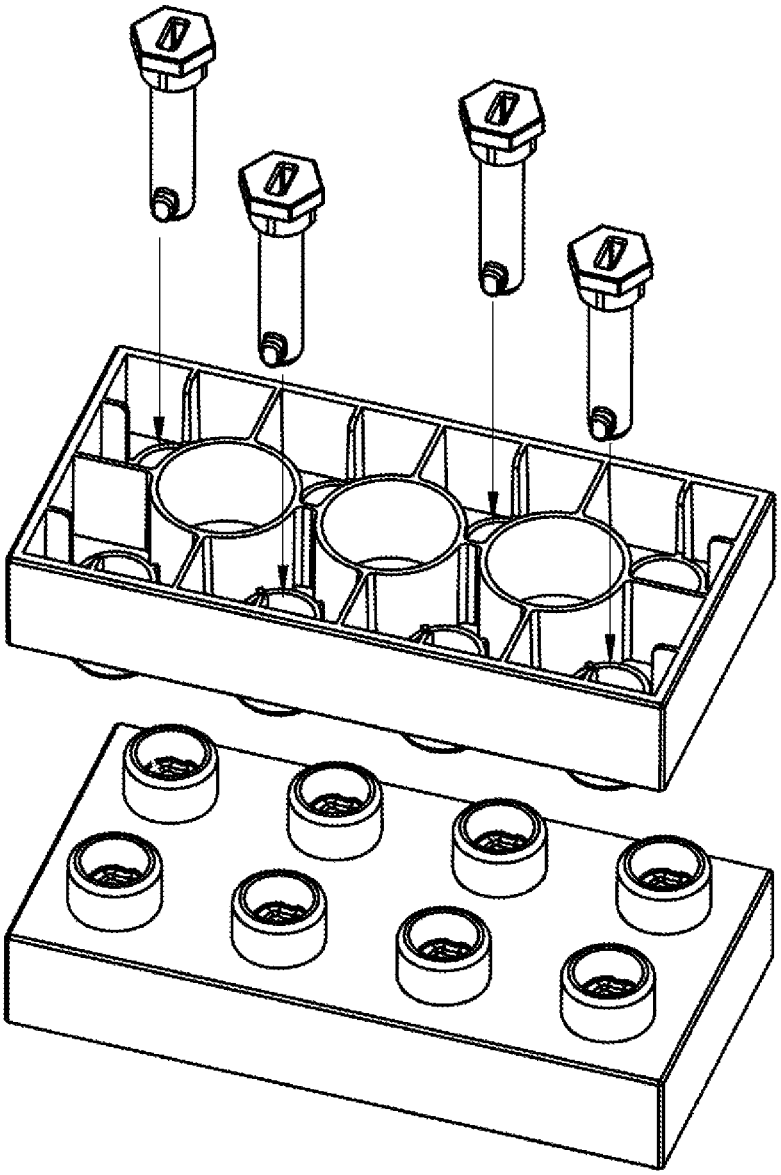
FIGS. 17, 17A and 17B depict a second variation of building block interlocking.
Figure 17A:
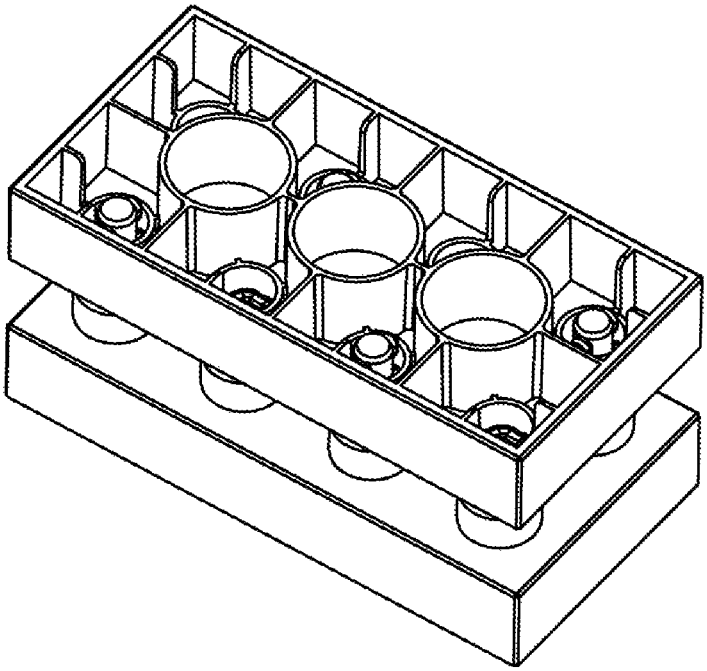
Figure 17B:
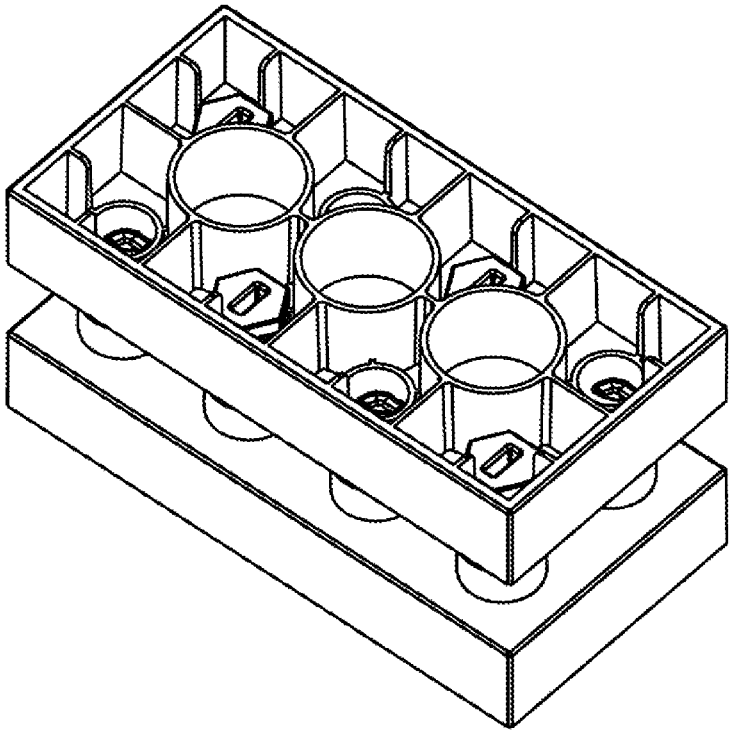

In the assembly depicted in FIGS. 17, 17A and 17B, the building blocks are stacked such that the mating protrusions of adjacent building blocks are opposite and in abutment. Fasteners are inserted from the side of the lower mating portion of the building block on one side for engagement with the fastener anchoring device on a building block on the other side.

Figure 18:
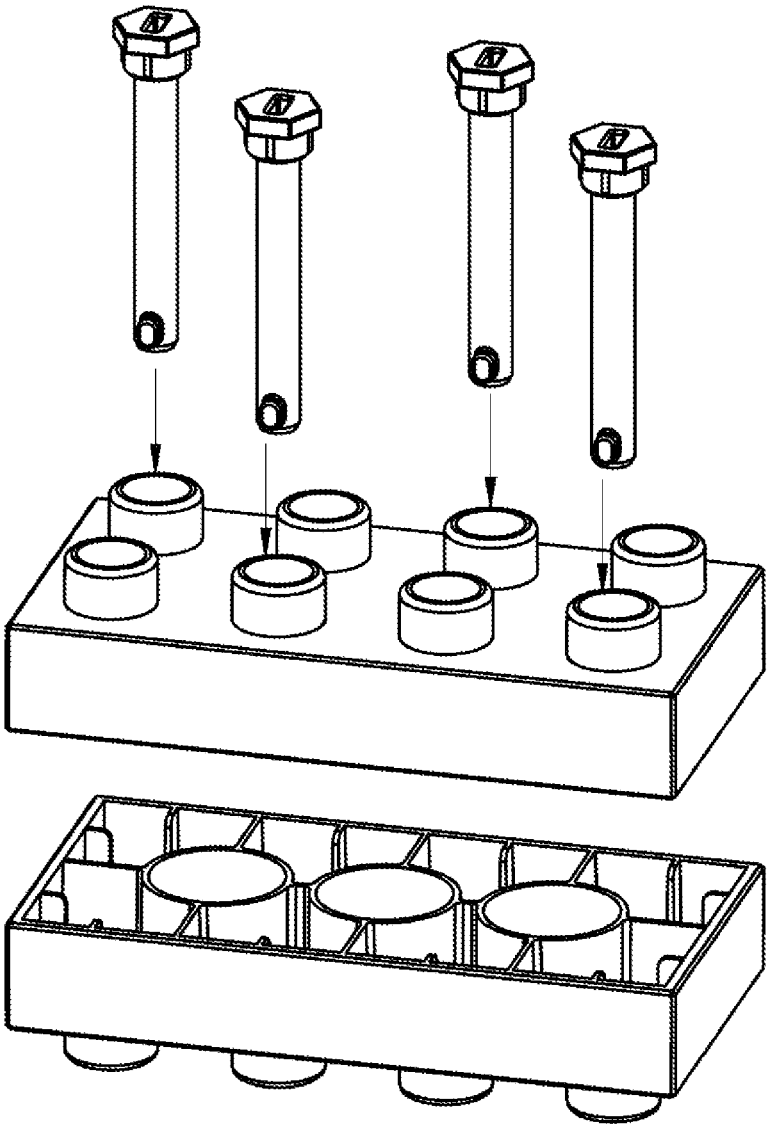
FIGS. 18, 18A and 18B depict a third variation of building block interlocking.
Figure 18A:
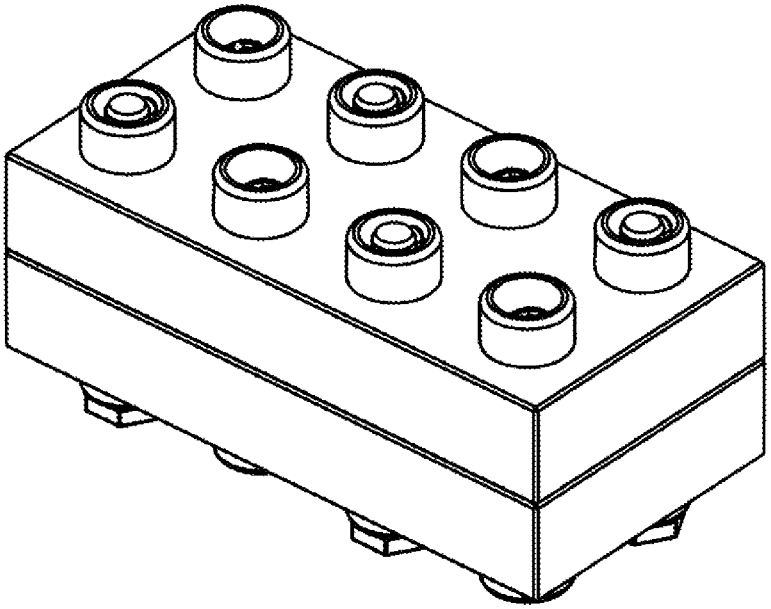
Figure 18B:
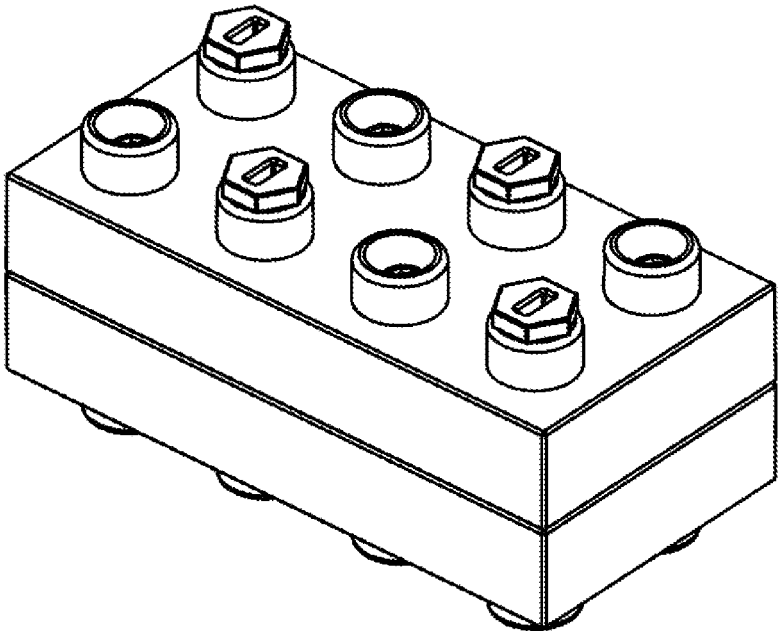

In the assembly depicted in FIGS. 18, 18A and 18B, the building blocks are stacked such that the lower mating portions of adjacent building blocks are opposite and in abutment. Fasteners are inserted from the side of the upper mating portion of the building block on one side for engagement with the fastener anchoring device on a building block on the other side. As the fastener anchoring device is further away from the portion of the building block which stops the head portion of the fastener, a fastener having a longer shaft portion is required in this variation.

In the above examples, it is noted that structures of various forms and configuration can be constructed from the building blocks and maintained in interlocking using fasteners of the type disclosed herein. Such versatility is possible because the fastener permits interlocking of building blocks by threaded engagement regardless of the relative orientation of the building blocks, provided that the building blocks are in mated coupling. For example, the fasteners herein permit inter-building block fastening, whether the two building blocks are parallel or orthogonally aligned, because the shaft portion of the fasteners is not restrained from axial movement by any of the building blocks. By providing a rotary engagement means at only one end of the fastener, such that the fastener will only enter into engagement, for example, threaded engagement, with only a fastening anchoring device on a destination building block, interlocking of building blocks irrespective of the alignment orientation is made possible.

While embodiments of the present inventions have been explained with reference to the examples above, the embodiments are non-limiting examples for illustrating the present inventions and should not be construed as to limit the scope of the invention. While the example building blocks described include a threaded portion of less than one complete thread turn, it will be appreciated that the threaded portion may comprise a plurality of threads without loss of generality. For example, the plurality of thread turns may be broken so that each continuous thread is less than one complete turn and the gap between neighboring thread turns are aligned such that the gaps collectively define a linear recess extending in a direction parallel to the bore axis of the upper mating protrusion. Furthermore, while the above example building blocks are moulded or formed of hard plastics, it will be appreciated that the building blocks can be moulded from concrete, metal, or other mouldable materials; or made from non-mouldable materials such as wood or metal components without loss of generality.

Table of Numerals

| | | | | | | | | |
|---|---|---|---|---|---|---|---|---|
| 100 | 200 | 300 | 400 | 500 | 600 | 700 | 800 | Building block |
| 120 | 220 | 320 | 420 | 520 | 620 | 720 | 820 | Base panel |
| 140 | 240 | 340 | 440 | 540 | 640 | 740 | 840 | Tubular portions |
| 142 | 242 | 342 | 442 | 542 | 642 | 742 | 842 | Cylindrical side wall |
| 144 | 244 | 344 | 444 | 544 | 644 | 744 | 844 | Bore of tubular portion |
| 146 | 246 | 346 | 446 | 546 | 646 | 746 | 846 | Helical thread |
| 148 | 248 | 348 | 448 | 548 | 648 | 748 | 848 | Gap on thread |
| 152 | 252 | 352 | 452 | 552 | 652 | 752 | 852 | Aperture defined by thread |
| 160 | 260 | 360 | 460 | 560 | 660 | 760 | 860 | Peripheral skirt |
| 162 | 262 | 362 | 462 | 562 | 662 | 762 | 862 | Side panels |
| 154 | 254 | 354 | 454 | 554 | 654 | 754 | 854 | Internal bore |
| 180 | 280 | 380 | 480 | 580 | 680 | 780 | 880 | receptacle |
| 182 | 282 | 382 | 482 | 582 | 682 | 782 | 882 | Panel forming receptacle |
| | | | | | | 790 | | Threaded tubular insert |
| | | | | | | 792 | | Tubular portion of insert |
| | | | | | | 794 | | Boss of insert |

-continued

| Table of Numerals | | | |
|---|---|---|---|
| 900 | 1000 | 1100 | Building block fastener |
| 910 | 1010 | 1110 | Head portion |
| 920 | 1020 | 1120 | end portion |
| 930 | 1030 | 1130 | Shaft portion |

The invention claimed is:

1. A building block comprising a first mating portion and a second mating portion:

wherein the first mating portion comprises a mating protrusion and the second mating portion comprises a mating receptacle, the mating protrusion projecting upwardly from a first surface in an axial direction and including an inside wall that defines an axially extending through bore and the mating receptacle projecting downwardly and away from the first surface;

wherein the mating receptacle is of a complementary shape to the mating protrusion, is in communication with the through bore, and is axially aligned with the through bore; and wherein a fastener anchoring device is formed on the inside wall of the mating protrusion, the mating protrusion including an overhanging portion which projects radially inwards from the inside wall and defines a secondary aperture inside the through bore;

wherein the overhanging portion is formed into a plurality of turns, and there is discontinuity between adjacent turns; and wherein the discontinuity between adjacent turns is in the form of a gap, and the gaps of the plurality of turns define a linear recess extending in a longitudinal direction parallel to the axial direction.

2. The building block according to claim 1, wherein the overhanging portion is integrally molded on said inside wall.

3. The building block according to claim 1, wherein the overhanging portion is formed as a helically threaded portion and projects radially inwards to overhang the inside wall.

4. The building block according to claim 1, wherein the overhanging portion comprises an overhanging projecting portion that projects radially inwards and extends around said inside wall at a constant axial level.

5. The building block according to claim 1, wherein the overhanging portion extends around the inside wall and has less than one complete turn.

6. The building block according to claim 1, wherein a plurality of said mating protrusions is formed on said first mating portion and the mating protrusions are distributed in the form of an array or a matrix in which separation distances between adjacent mating protrusions along a direction is uniform, and wherein a corresponding plurality of said mating receptacles is formed on said second mating portion.

7. The building block according to claim 1, wherein the building block comprises a base panel defining said first surface and a peripheral skirt projecting downwardly from said base panel and surrounding said base panel, and wherein the mating receptacle is formed as a partitioning structure inside said peripheral skirt.

8. A building block and a fastener in combination, wherein the building block comprises a first mating portion and a second mating portion, the first mating portion comprises a mating protrusion and the second mating portion comprises a mating receptacle:

wherein the first mating protrusion projects upwardly from a first surface in an axial direction and includes an inside wall that defines an axially extending through bore and the mating receptacle projects downwardly and away from the first surface;

wherein the mating receptacle is of a complementary shape to the mating protrusion, is in communication with the through bore, and is axially aligned with the through bore;

wherein a fastener anchoring device is formed on the inside wall of the mating protrusion, the mating protrusion including an overhanging portion which projects radially inwards from the inside wall and defines a secondary aperture inside the through bore;

wherein the fastener comprises a head portion, an end portion comprising an engagement means, and a shaft portion interconnecting the head portion and the end portion, the engagement means comprising an overhanging portion which projects radially outwards of said shaft portion;

wherein the through bore is shaped and sized to permit sliding insertion of said engagement means into said through bore, the overhanging portion of the fastener anchoring device is shaped and sized to block axial advancement of the engagement means but to allow axial advancement of the engagement means into the fastener anchoring device and to make engagement therewith upon the engagement means making rotational negotiation with the fastener anchoring device, and the secondary aperture defined by the overhanging portion is shaped and sized to allow sliding movement of said shaft portion;

wherein the overhanging portion is formed into a plurality of turns, and there is discontinuity between adjacent turns; and wherein the discontinuity between adjacent turns is in the form of a gap, and the gaps of the plurality of turns define a linear recess extending in a longitudinal direction parallel to the axial direction.

9. The building block and the fastener in combination according to claim 8, wherein the overhanging portion of the fastener anchoring device is shaped and sized to engage with the engagement means of the fastener when the engagement means rotates and advances into an engagement position inside said fastener anchoring device.

10. The building block and the fastener in combination according to claim 9, wherein the overhanging portion of the fastener anchoring device is shaped and sized to release engagement between the engagement means and the overhanging portion when the engagement means rotates and advances further after entering into the engagement position.

11. The building block and the fastener in combination according to claim 8, wherein the overhanging portion of the fastener anchoring device is shaped and sized to permit slide-through passage rotation of the shaft portion and to block passage of the head portion of the fastener.

12. The building block and the fastener in combination according to claim 8, wherein the mating protrusion is in the shape of an axially extending tubular portion projecting above the first surface and having a free axial end, and the free axial end is shaped and sized to block passage of the head portion of the fastener.

13. The building block and the fastener in combination according to claim 8, wherein the building block comprises a base panel defining said first surface and a peripheral skirt projecting axially downwards from and surrounding said base panel and defining an axial depth of the second mating portion below the base panel, and the mating receptacle is formed as a partitioning structure inside said peripheral skirt; and wherein the mating protrusion has an axial height less than the axial depth.

14. The building block and the fastener in combination according to claim 8, wherein the overhanging portion is integrally molded on said inside wall.

15. The building block and the fastener in combination according to claim 8, wherein the overhanging portion is formed as a helically threaded portion projecting inwardly from the inside wall.

16. An assembly comprising a first building block and a second building block forming a stacked structure or part thereof, the first and second building blocks being interlocked together by a fastener; wherein each of the first and second building blocks comprises a first mating portion and a second mating portion, the first mating portion comprises a mating protrusion and the second mating portion comprises a mating receptacle:

wherein the first mating protrusion projects upwardly from a first surface in an axial direction and includes an inside wall that defines an axially extending through bore and the mating receptacle projects downwardly and away from the first surface;

wherein the mating receptacle is of a complementary shape to the mating protrusion, is in communication with the through bore, and is axially aligned with the through bore;

wherein a fastener anchoring device is formed on the inside wall of the mating protrusion, the mating protrusion including an overhanging portion which projects radially inwards from the inside wall and defines a secondary aperture inside the through bore;

wherein the fastener comprises a head portion, an end portion comprising an engagement means, and a shaft portion interconnecting the head portion and the end portion, the engagement means comprising an overhanging portion which projects radially outwards of said shaft portion;

wherein the through bore is shaped and sized to permit sliding insertion of said engagement means into said through bore, the overhanging portion of the fastener anchoring device is shaped and sized to block axial advancement of the engagement means but to allow axial advancement of the engagement means into the fastener anchoring device and to make engagement therewith upon the engagement means making rotational negotiation with the fastener anchoring device, and the secondary aperture defined by the overhanging portion is shaped and sized to allow sliding movement of said shaft portion;

wherein the mating protrusion of the first building block is axially aligned with the mating receptacle of the second building block, the head portion of the fastener is anchored on the mating protrusion of the first block, and the engagement means of the fastener is in engagement with the fastener anchoring device of the second block;

wherein the overhanging portion is formed into a plurality of turns, and there is discontinuity between adjacent turns; and wherein the discontinuity between adjacent turns is in the form of a gap, and the gaps of the plurality of turns define a linear recess extending in a longitudinal direction parallel to the axial direction.

17. The assembly according to claim 16, wherein the mating protrusion is in the shape of an axially extending tubular portion projecting above the first surface and having a free axial end, and the free axial end is shaped and sized to block passage of the head portion of the fastener; and wherein the head portion of the fastener is anchored on the free axial end of the mating protrusion of the first block and the engagement means of the fastener is in engagement with the overhanging portion of the fastener anchoring device of the second block.

18. The assembly according to claim 16, wherein a helical thread is formed on the overhanging portion of the fastener anchoring device or on the engagement means of the fastener such that rotation of the fastener in a first direction gradually tightens interlocking between the first and the second building blocks, and rotation of the fastener in a second direction opposite to the first direction gradually loosens interlocking between the first and the second building blocks.

* * * * *